US011406183B1

(12) United States Patent
Olander et al.

(10) Patent No.: US 11,406,183 B1
(45) Date of Patent: Aug. 9, 2022

(54) STAND FOR SUPPORTING A COMPUTING DEVICE

(71) Applicant: Roost Industries Corp., Aurora, CO (US)

(72) Inventors: James Dotson Olander, Denver, CO (US); Zachary Earl Conrad, Denver, CO (US); James Walter Moennich, Oberlin, OH (US)

(73) Assignee: Roost Industries Corp., Aurora, CO (US)

( * ) Notice: Subject to any disclaimer, the term of this patent is extended or adjusted under 35 U.S.C. 154(b) by 0 days.

(21) Appl. No.: 17/367,780

(22) Filed: Jul. 6, 2021

Related U.S. Application Data

(63) Continuation-in-part of application No. 29/797,937, filed on Jul. 4, 2021.

(51) Int. Cl.
*A47B 23/04* (2006.01)

(52) U.S. Cl.
CPC ..... *A47B 23/043* (2013.01); *A47B 2023/049* (2013.01)

(58) Field of Classification Search
None
See application file for complete search history.

(56) References Cited

U.S. PATENT DOCUMENTS

| | | | |
|---|---|---|---|
| 677,216 | A | 6/1901 | Huebner |
| 929,989 | A | 8/1922 | Sharp |
| 1,837,826 | A | 12/1922 | Mitchell |
| 1,838,856 | A | 12/1922 | Mitchell |
| 1,840,620 | A | 1/1932 | Dennis |
| 2,373,617 | A | 4/1945 | Tiryakian |
| 2,441,932 | A | 5/1948 | Curry |
| 2,694,442 | A | 11/1954 | Nordmark |
| 2,722,972 | A | 11/1955 | Altruda |
| 3,899,164 | A | 8/1975 | Newman |
| 3,991,967 | A | 11/1976 | Sack |
| 3,995,882 | A | 12/1976 | Watkins |
| 4,118,065 | A | 10/1978 | Watkins |
| 4,714,224 | A | 12/1987 | Calmes |
| 4,726,556 | A | 2/1988 | Weir |

(Continued)

FOREIGN PATENT DOCUMENTS

| | | |
|---|---|---|
| CN | 101604187 | 12/2009 |
| CN | 101701660 | 5/2010 |

(Continued)

OTHER PUBLICATIONS

Wayback Machine, Human Solutions online brochure, http://web.archive.org/web/20130818085003/http://www.thehumansolution.com/innovativecricket-portable-laptop-pc-stand.html, 4 pages, retrieved on Apr. 14, 2014.

(Continued)

*Primary Examiner* — Steven M Marsh
(74) *Attorney, Agent, or Firm* — FisherBroyles, LLP; Craig W. Mueller

(57) ABSTRACT

A stand for supporting a computing device is provided. The stand may support the computing device at a height such that a screen of the computing device is capable of being at or near eye-level of a user. The stand may include a frame member and a gripping mechanism attached to an end of the frame member. The gripping mechanism may secure the computing device to the stand.

17 Claims, 23 Drawing Sheets

(56) References Cited

U.S. PATENT DOCUMENTS

| | | | | |
|---|---|---|---|---|
| 5,129,616 | A | 7/1992 | Carson | |
| 5,149,046 | A | 9/1992 | Kerley | |
| 5,308,035 | A | 5/1994 | Ross | |
| 5,388,852 | A | 2/1995 | Bigo | |
| 5,492,299 | A | 2/1996 | Thermos et al. | |
| 5,651,525 | A | 7/1997 | Yang | |
| 5,794,639 | A | 8/1998 | Einbinder | |
| 5,797,578 | A | 8/1998 | Graffeo et al. | |
| 5,833,178 | A | 11/1998 | Plasse et al. | |
| 5,845,889 | A | 12/1998 | Suzuki | |
| 6,006,580 | A * | 12/1999 | Frawley | B21D 1/12 248/166 |
| 6,073,894 | A | 6/2000 | Chen | |
| 6,076,787 | A | 6/2000 | Troyer | |
| 6,244,011 | B1 | 6/2001 | Esser | |
| 6,260,486 | B1 | 7/2001 | Boos et al. | |
| 6,382,716 | B1 | 5/2002 | Wu | |
| 6,488,331 | B2 | 12/2002 | Chen | |
| 6,634,304 | B2 | 10/2003 | Wang | |
| 6,666,223 | B2 | 12/2003 | Price et al. | |
| 6,676,100 | B2 | 1/2004 | Hsu | |
| 6,792,880 | B2 | 9/2004 | Tsai | |
| 6,944,012 | B2 | 9/2005 | Doczy et al. | |
| 7,066,438 | B2 | 6/2006 | Ma | |
| 7,108,275 | B2 | 9/2006 | Yeh | |
| 7,229,128 | B2 | 6/2007 | Lee | |
| D562,572 | S | 2/2008 | Nothel et al. | |
| 7,637,468 | B2 | 12/2009 | Huang | |
| 7,712,719 | B2 | 5/2010 | Derry | |
| 7,717,502 | B2 | 5/2010 | Deng | |
| 7,748,667 | B1 | 7/2010 | Bartholomew | |
| D634,311 | S | 3/2011 | Stifal | |
| 8,020,818 | B2 | 9/2011 | Chou | |
| 8,172,191 | B1 | 5/2012 | Zimbalatti | |
| D668,256 | S | 10/2012 | Matteo | |
| D669,482 | S | 10/2012 | Hu | |
| D672,782 | S | 12/2012 | Gross | |
| D677,262 | S | 3/2013 | Lewis | |
| D689,500 | S | 9/2013 | Faulk | |
| 8,534,619 | B2 | 9/2013 | Huang et al. | |
| D694,761 | S | 12/2013 | Zoll | |
| D696,261 | S | 12/2013 | Weldon | |
| D701,212 | S | 3/2014 | Blevins | |
| 8,708,298 | B2 | 4/2014 | Hu | |
| D704,195 | S | 5/2014 | Marquette | |
| D704,714 | S | 5/2014 | Christiano | |
| D714,281 | S | 9/2014 | Reznik | |
| 8,899,543 | B2 | 12/2014 | Liang | |
| 9,097,481 | B2 * | 8/2015 | Chaney | F41A 23/14 |
| 9,104,372 | B2 | 8/2015 | Frenzel | |
| 9,211,001 | B2 | 12/2015 | Negretti | |
| D750,088 | S | 2/2016 | Reznik | |
| D757,019 | S | 5/2016 | Pitteri | |
| D764,478 | S | 8/2016 | Radmard | |
| D770,460 | S | 11/2016 | Won | |
| 9,482,383 | B1 | 11/2016 | Wei | |
| D783,628 | S | 4/2017 | Pitteri | |
| 9,625,081 | B2 | 4/2017 | Olander | |
| D792,417 | S | 7/2017 | Xiang | |
| 9,828,221 | B2 * | 11/2017 | Mohr | B66F 7/08 |
| 9,894,988 | B2 | 2/2018 | Olander | |
| D827,652 | S | 9/2018 | Jacques | |
| D829,216 | S | 9/2018 | Belitz | |
| 10,070,719 | B2 | 9/2018 | Olander | |
| 10,098,452 | B2 | 10/2018 | Ko | |
| 10,113,684 | B2 * | 10/2018 | Hou | G06F 1/1632 |
| D832,726 | S | 11/2018 | Kim | |
| D838,724 | S | 1/2019 | Olander | |
| D860,216 | S | 9/2019 | Olander | |
| 2003/0111582 | A1 | 6/2003 | Bakker | |
| 2004/0084581 | A1 | 5/2004 | Chang | |
| 2005/0103969 | A1 | 5/2005 | Gaines | |
| 2006/0054753 | A1 | 3/2006 | Lee | |
| 2006/0108494 | A1 | 5/2006 | Lancet | |
| 2008/0054149 | A1 | 3/2008 | Freebairn | |
| 2008/0224515 | A1 | 9/2008 | Cui | |
| 2008/0251659 | A1 | 10/2008 | Matias | |
| 2008/0301927 | A1 | 12/2008 | Miller | |
| 2009/0179132 | A1 | 7/2009 | Qin et al. | |
| 2009/0241811 | A1 | 10/2009 | Markegard | |
| 2010/0213330 | A1 | 8/2010 | Downing | |
| 2010/0276560 | A1 | 11/2010 | Farris-Gilbert et al. | |
| 2011/0149510 | A1 | 6/2011 | Monsalve | |
| 2011/0226916 | A1 | 9/2011 | Leung | |
| 2011/0227373 | A1 | 9/2011 | Cone, II | |
| 2012/0145835 | A1 | 6/2012 | Zaharakis | |
| 2012/0210912 | A1 | 8/2012 | Florendo | |
| 2013/0001379 | A1 | 1/2013 | Hobbs | |
| 2013/0048801 | A1 | 2/2013 | Weinberg | |
| 2013/0175421 | A1 | 7/2013 | Faulk | |
| 2013/0277529 | A1 * | 10/2013 | Bolliger | F16M 13/00 248/676 |
| 2013/0286323 | A1 | 10/2013 | Kuo | |
| 2014/0110556 | A1 | 4/2014 | Mao | |
| 2014/0124631 | A1 * | 5/2014 | Dander | F16M 11/10 248/164 |
| 2016/0138753 | A1 | 5/2016 | Crossland | |
| 2018/0125229 | A1 | 5/2018 | Olander | |
| 2018/0192770 | A1 | 7/2018 | Lu | |
| 2018/0252353 | A1 | 9/2018 | Hou | |

FOREIGN PATENT DOCUMENTS

| | | |
|---|---|---|
| CN | 201535421 | 7/2010 |
| CN | 102748568 | 7/2012 |
| CN | 202691496 | 1/2013 |
| WO | WO2009135402 | 12/2009 |
| WO | WO2010040754 | 4/2010 |
| WO | WO2014071064 | 5/2014 |

OTHER PUBLICATIONS

Foldable Aluminum Laptop Stand for Desk Bed Table Floor, Ergonomic Multiple Portable Adjustable Notebook Computer Laptop Holder for Home Office. https://www.primesmartstore.com/product/foldable-aluminum-laptop-stand-for-desk-bed-table-floor-ergonomic-multiple-portable-adjustable-notebook-computer-laptop-holder-for-home-office/. 3 pages.

International Search Report for International Application No. PCT/US2013/067856, dated Mar. 28, 2014, 3 pages.

Written Opinion for International Application No. PCT/US2013/067856, dated Mar. 28, 2014, 5 pages.

NEXSTAND K2 Manual, accessed from http://www.nexstand.com/ believed to be active since Jun. 2016. 2 pages.

* cited by examiner

STAND FOR SUPPORTING A COMPUTING DEVICE

This application is a continuation-in-part of U.S. patent application Ser. No. 29/797,937, filed Jul. 4, 2021, the entirety of which is incorporated by reference herein.

This application related to U.S. Pat. Nos. 9,625,081, 9,894,988, 10,070,719, D838,724, and D860,216, the entireties of which are incorporated by reference herein.

FIELD OF THE INVENTION

Embodiments of the present invention are generally related to a stand for supporting a computing device, such as a laptop computer.

BACKGROUND OF THE INVENTION

The prevalence of repetitive use injuries from consumer electronics is continually increasing amongst technology users. For example, when situated on a desk or table, a laptop computer has a screen positioned typically one to three feet lower than eye level. This positioning arrangement forces a head-down user posture that is dangerous for extended sessions at the laptop computer and contributes greatly to computer-related repetitive use injuries.

SUMMARY OF THE INVENTION

It is one aspect of some embodiments of the present invention to provide a stand for positioning a mobile computing device at an elevated position. When used in association with a laptop computer, the stand elevates a laptop computer screen to near eye level so that a user may maintain a more ergonomically correct working position, thereby reducing repetitive use injuries from using the laptop computer. The stand may be portable, allowing a user to work at remote locations away from their home or office in a more ergonomically correct position. The stand of embodiment is made without pins.

In one example, a collapsible stand for use with a mobile computing device is provided. The stand may include a first side frame structure, a second side frame structure, and a cross frame structure interconnecting the first and second side-frame structures. The cross frame structure of one embodiment is operably coupled to the first and second side-frame structures such that the first and second side-frame structures are oriented parallel or substantially parallel to one another as the stand is moved from a fully extended to a collapsed position.

The first and second side frame structures include an elongate arm with an upper arm configured to engage the laptop's screen and a leg rotatably attached to the arm such that the leg rotates and slides relative to the arm. Gripping mechanisms are attached to ends of the legs that are configured to grasp and secure the lower edge of the laptop such that the laptop is suspended from its bottom edge.

The first and second side frame structures may include a cross link pivotally attached at one end to the arm and pivotally attached at another end to the leg. The first and second side frame structures may include a height adjustment mechanism to the arm to prevent the leg's gripping mechanism from moving beyond a predetermined point.

The cross frame structure may include a pair of elongate, offset cross frame members pivotally attached at lower ends to lower ends of the arms of the first and second side frame structures and pivotally attached at upper ends to the legs of the first and second side frame structures. The cross frame members may be pivotally attached intermediate their respective ends.

The upper ends of the cross frame members may be slidably attached to the first and second side frame structures such that the upper ends of the cross frame members move away from the lower ends of the arms when the stand is transitioned from an extended position to a collapsed position. When the stand is in the extended position, the upper ends of the cross frame members may be lockable relative to the lower ends of the arms to prevent or substantially prevent the stand from expanding beyond a predetermined width.

Thus, it is one aspect of embodiments of the present invention to provide a stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; and a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use.

It is another aspect of some embodiments of the present invention to provide a stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is movable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is movable along a length of the third elongate frame member; operatively interconnected cross frame members interconnecting the first side frame structure to the second side frame structure, wherein the first cross frame member and second cross frame member rotate relative to each other when the first side structure and second side structure are moved apart to configure the stand in an expanded position of use and moved together to configure the stand in a collapsed position of use; and a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use.

It is still yet another aspect of embodiments of the present invention to provide a stand for supporting a computing device above a support surface, the stand comprising: a first side-frame structure including a first elongate frame member and a second elongate frame member, the second elongate frame member attached to the first elongate frame member such that the second elongate frame member is pivotable relative to the first elongate frame member and is slideable along a length of the first elongate frame member, the second elongate frame member including an upper end portion that extends beyond the first elongate frame member, the upper end portion of the second elongate frame member and an upper end portion of the first elongate frame member are each configured to engage the computing device when the stand is in a fully-extended position; a second side-frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member, the fourth elongate frame member including an upper end portion that extends beyond the third elongate frame member, the upper end portion of the fourth elongate frame member and an upper end portion of the third elongate frame member are each configured to engage the computing device when the stand is in the fully-extended position; a cross-frame structure positioned between the first and second side-frame structures, the cross-frame structure attached to the first and second side-frame structures such that the first and second side-frame structures are oriented substantially parallel to one another during collapse of the stand from the fully-extended position to a fully-collapsed position, wherein each of the first, second, third, and fourth elongate frame members is oriented at an oblique angle relative to the support surface when the stand is in the fully-extended position; the improvement comprising: a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the fully-extended position.

Further aspects of the present invention are provided in the following embodiments:

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the height adjustment and maintaining mechanism slides along a channel provided in the first elongate frame member that includes a plurality of teeth, and wherein the height adjustment and maintaining mechanism is comprised of a carrier with at least one deflectable member ending in a protrusion configured to engage a space provided between adjacent teeth when the at least one arm is urged inwardly towards the first elongate frame member by a lock operatively interconnected to the carrier.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the height adjustment and maintaining mechanism slides along a channel provided in the first elongate frame member, the height adjustment and maintaining mechanism having an upper end that is biased towards the first elongate frame member, the upper end having at least one inwardly-extending detent that is selectively received within a cavity provided in the front elongate member.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the height adjustment and maintaining mechanism is a first height adjustment and maintaining mechanism, and further comprising a second height adjustment and maintaining mechanism operatively interconnected to the third elongate frame member, the second height adjustment member configured to selectively slide along a portion of the third elongate frame member, the second height adjustment member configured to selectively engage and fixedly interconnect to a predetermined location on the third elongate frame member, and wherein the second height adjustment member has an upper surface configured to engage a portion of the fourth elongate member when the stand is positioned in the expanded position of use.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the second elongate member has a first opening that operatively receives the head of the first cross member and a second opening that the first elongate frame member passes through; wherein the fourth elongate member has a third opening that operatively receives the head of the second cross member and a fourth opening that the third elongate frame member passes through; wherein the head of the first cross member comprises a spherical outer profile that operatively interfaces with a corresponding profile provided in the first opening; wherein the head of the second cross member comprises a spherical outer profile that operatively interfaces with a corresponding profile provided in the third opening; wherein the head of the first cross member further comprises a fifth opening that the first elongate frame member passes through; and wherein the head of the second cross member further comprises a sixth opening that the first elongate frame member passes through.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the head of the first cross member further comprises a planar outer surface that is flush with an outer surface of the second elongate frame member when the stand is in the collapsed configuration of use, and wherein the head of the second cross member further comprises a planar outer surface that is flush with an outer surface of the fourth elongate frame member when the stand is in the collapsed configuration of use.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein second and fourth elongate frame members include internal surfaces that contact each other when the stand is in the collapsed configuration of use to conceal the majority of rear surfaces of the first and second cross members.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein: the first side frame structure further includes a first cross link member pivotally attached at a first end to the first elongate frame member and at a second end to the second elongate frame member; and the second side frame structure further includes a second cross link member pivotally attached at a first end to the third elongate frame member and at a second end to the fourth elongate frame member.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and further including a first pull tab interconnected the base segment of the first elongate frame member, and a second pull tab interconnected the base segment of the third elongate frame member.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; further including a first pull tab interconnected the base segment of the first elongate frame member, and a second pull tab interconnected the base segment of the third elongate frame member; and wherein the first and second pull tabs are biased against corresponding outer surfaces of first and second elongate frame members.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the second elongate member and the fourth elongate member each include a gripping mechanism adapted to selectively engage a portion of the computing device, the gripping mechanisms including members configured to move in an arcuate path relative to the second elongate member and the fourth elongate member.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is slideable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member; a first cross frame member having a first end operatively associated with the first elongate frame member and the second elongate frame member and a second end operatively interconnected of a base segment of the third elongate frame member; the second cross frame member having a first end operatively associated with the third elongate frame member and the fourth elongate frame member and a second end operatively interconnected of a base segment of the first elongate frame member; wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; wherein the second elongate member and the fourth elongate member each include a gripping mechanism adapted to selectively engage a portion of the computing device, the gripping mechanisms including members configured to move in an arcuate path relative to the second elongate member and the fourth elongate member; and wherein the gripping mechanisms further include elastic members attached to the member and respective second or fourth elongate frame members, the elastic members located in channels integrated into the members and held in place by at least one inwardly-extending finger.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is movable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is movable along a length of the third elongate frame member; operatively interconnected cross frame members interconnecting the first side frame structure to the second side frame structure, wherein the first cross frame member and second cross frame member rotate relative to each other when the first side structure and second side structure are moved apart to configure the stand in an expanded position of use and moved together to configure the stand in a collapsed position of use; and a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is movable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is movable along a length of the third elongate frame member; operatively interconnected cross frame members interconnecting the first side frame structure to the second side frame structure, wherein the first cross frame member and second cross frame member rotate relative to each other when the first side structure and second side structure are moved apart to configure the stand in an expanded position of use and moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the height adjustment and maintaining mechanism slides along a channel provided in the first elongate frame member that includes a plurality of teeth, and wherein the height adjustment and maintaining mechanism is comprised of a carrier with at least one deflectable member ending in a protrusion configured to engage a space provided between adjacent teeth when the at least one arm is urged inwardly towards the first elongate frame member by a lock operatively interconnected to the carrier.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is movable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is movable along a length of the third elongate frame member; operatively interconnected cross frame members interconnecting the first side frame structure to the second side frame structure, wherein the first cross frame member and second cross frame member rotate relative to each other when the first side structure and second side structure are moved apart to configure the stand in an expanded position of use and moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and further including a first pull tab interconnected the base segment of the first elongate frame member, and a second pull tab interconnected the base segment of the third elongate frame member.

A stand for supporting a computing device above a support surface, the stand comprising: a first side frame structure including a first elongate frame member and a second elongate frame member, the second elongate frame member attached to the first elongate frame member such that the second elongate frame member is pivotable relative to the first elongate frame member and is movable along a length of the first elongate frame member; a second side frame structure including a third elongate frame member and a fourth elongate frame member, the fourth elongate frame member attached to the third elongate frame member such that the fourth elongate frame member is pivotable relative to the third elongate frame member and is movable along a length of the third elongate frame member; operatively interconnected cross frame members interconnecting the first side frame structure to the second side frame structure, wherein the first cross frame member and second cross frame member rotate relative to each other when the first side structure and second side structure are moved apart to configure the stand in an expanded position of use and moved together to configure the stand in a collapsed position of use; a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the second elongate member and the fourth elongate member each include a gripping mechanism adapted to selectively engage a portion of the computing device, the gripping mechanisms including members configured to move in an arcuate path relative to the second elongate member and the fourth elongate member.

A stand for supporting a computing device above a support surface, the stand comprising: a first side-frame structure including a first elongate frame member and a second elongate frame member, the second elongate frame member attached to the first elongate frame member such that the second elongate frame member is pivotable relative to the first elongate frame member and is slideable along a length of the first elongate frame member, the second elongate frame member including an upper end portion that extends beyond the first elongate frame member, the upper end portion of the second elongate frame member and an upper end portion of the first elongate frame member are each configured to engage the computing device when the stand is in a fully-extended position; a second side-frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member, the fourth elongate frame member including an upper end portion that extends beyond the third elongate frame member, the upper end portion of the fourth elongate frame member and an upper end portion of the third elongate frame member are each configured to engage the computing device when the stand is in the fully-extended position; a cross-frame structure positioned between the first and second side-frame structures, the cross-frame structure attached to the first and second side-frame structures such that the first and second side-frame structures are oriented substantially parallel to one another during collapse of the stand from the fully-extended position to a fully-collapsed position, wherein each of the first, second, third, and fourth elongate frame members is oriented at an oblique angle relative to the support surface when the stand is in the fully-extended position; the improvement comprising: a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the fully-extended position; and wherein the height adjustment and maintaining mechanism slides along a channel provided in the first elongate frame member that includes a plurality of teeth, and wherein the height adjustment and maintaining mechanism is comprised of a carrier with at least one deflectable member ending in a protrusion configured to engage a space provided between adjacent teeth when the at least one arm is urged inwardly towards the first elongate frame member by a lock operatively interconnected to the carrier.

A stand for supporting a computing device above a support surface, the stand comprising: a first side-frame structure including a first elongate frame member and a second elongate frame member, the second elongate frame member attached to the first elongate frame member such that the second elongate frame member is pivotable relative to the first elongate frame member and is slideable along a length of the first elongate frame member, the second elongate frame member including an upper end portion that extends beyond the first elongate frame member, the upper end portion of the second elongate frame member and an upper end portion of the first elongate frame member are each configured to engage the computing device when the stand is in a fully-extended position; a second side-frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member, the fourth elongate frame member including an upper end portion that extends beyond the third elongate frame member, the upper end portion of the fourth elongate frame member and an upper end portion of the third elongate frame member are each configured to engage the computing device when the stand is in the fully-extended position; a cross-frame structure positioned between the first and second side-frame structures, the cross-frame structure attached to the first and second side-frame structures such that the first and second side-frame structures are oriented substantially parallel to one another during collapse of the stand from the fully-extended position to a fully-collapsed position, wherein each of the first, second, third, and fourth elongate frame members is oriented at an oblique angle relative to the support surface when the stand is in the fully-extended position; the improvement comprising: a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the fully-extended position; and further including a first pull tab interconnected a base segment of the first elongate frame member, and a second pull tab interconnected the base segment of a third elongate frame member.

A stand for supporting a computing device above a support surface, the stand comprising: a first side-frame structure including a first elongate frame member and a second elongate frame member, the second elongate frame member attached to the first elongate frame member such that the second elongate frame member is pivotable relative to the first elongate frame member and is slideable along a length of the first elongate frame member, the second elongate frame member including an upper end portion that extends beyond the first elongate frame member, the upper end portion of the second elongate frame member and an upper end portion of the first elongate frame member are each configured to engage the computing device when the stand is in a fully-extended position; a second side-frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member, the fourth elongate frame member including an upper end portion that extends beyond the third elongate frame member, the upper end portion of the fourth elongate frame member and an upper end portion of the third elongate frame member are each configured to engage the computing device when the stand is in the fully-extended position; a cross-frame structure positioned between the first and second side-frame structures, the cross-frame structure attached to the first and second side-frame structures such that the first and second side-frame structures are oriented substantially parallel to one another during collapse of the stand from the fully-extended position to a fully-collapsed position, wherein each of the first, second, third, and fourth elongate frame members is oriented at an oblique angle relative to the support surface when the stand is in the fully-extended position; the improvement comprising: a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the fully-extended position; and wherein the second elongate member and the fourth elongate member each include a gripping mechanism adapted to selectively engage a portion of the computing device, the gripping mechanisms including members configured to move in an arcuate path relative to the second elongate member and the fourth elongate member.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 6:
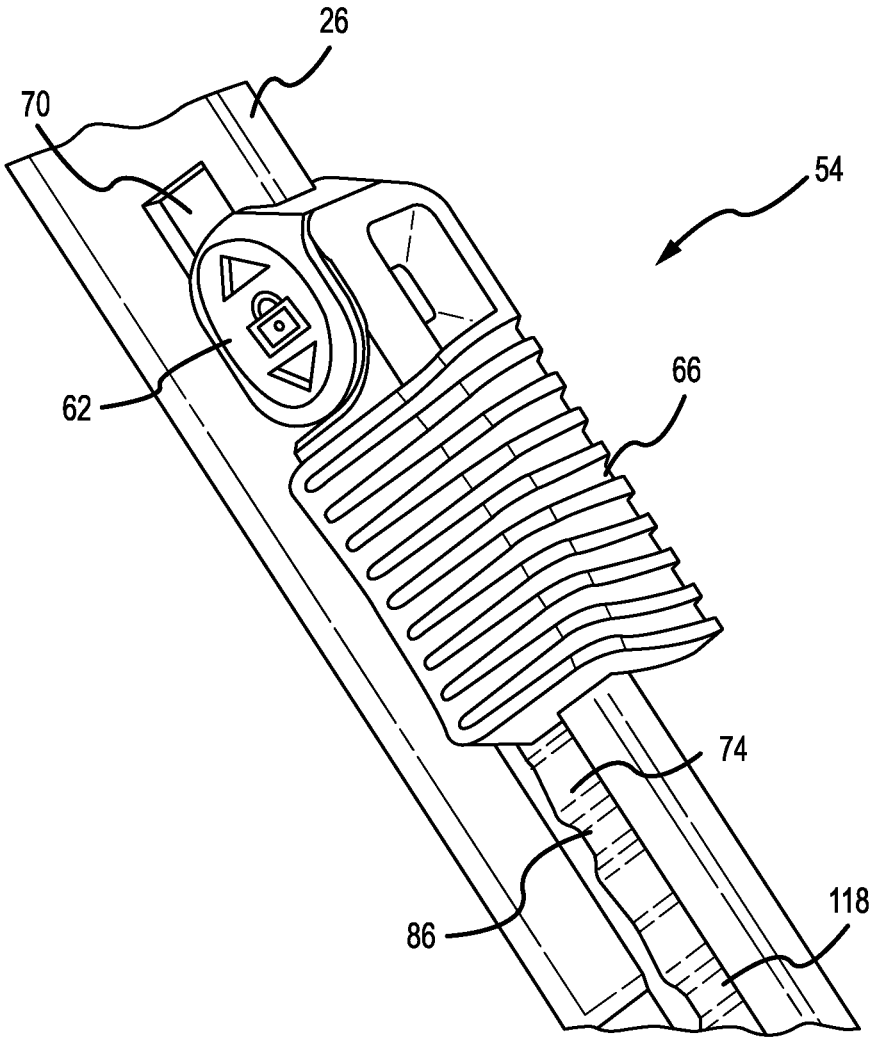
FIG. 6 is a detailed view showing a height adjusting and maintaining mechanism of one embodiment of the present invention.

7B is a front perspective view of the height adjusting and maintaining mechanism shown in FIG. 6 in an unlocked configuration of use.

Figure 7A:
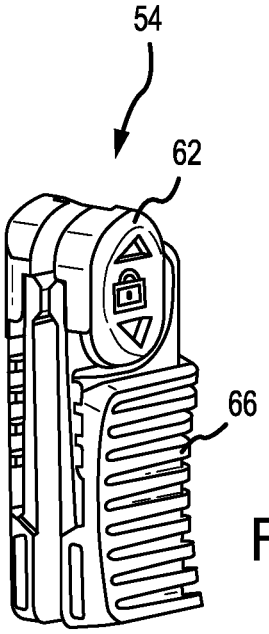
FIG. 7A is a front perspective view of the height adjusting and maintaining mechanism shown in FIG. 6 in a locked configuration of use.
Figure 7B:
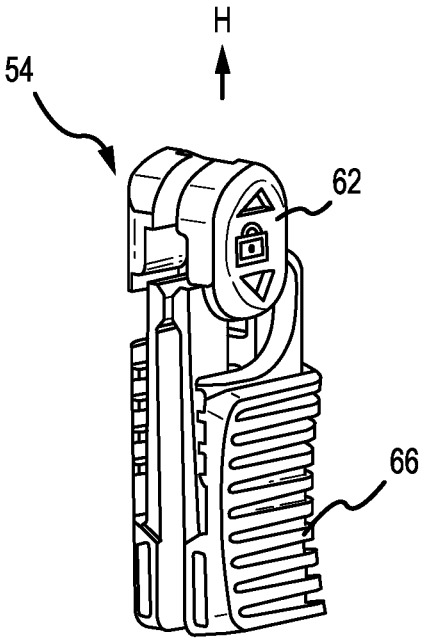
Figure 7C:
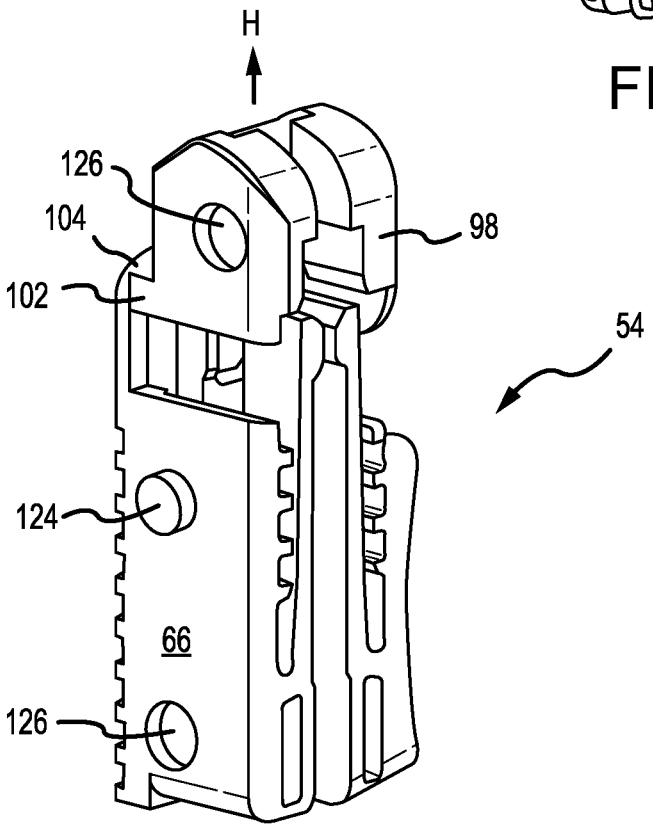

FIG. 7C is a rear perspective view of the height adjusting and maintaining mechanism shown in FIG. 6 in an unlocked configuration of use.

Figure 8:
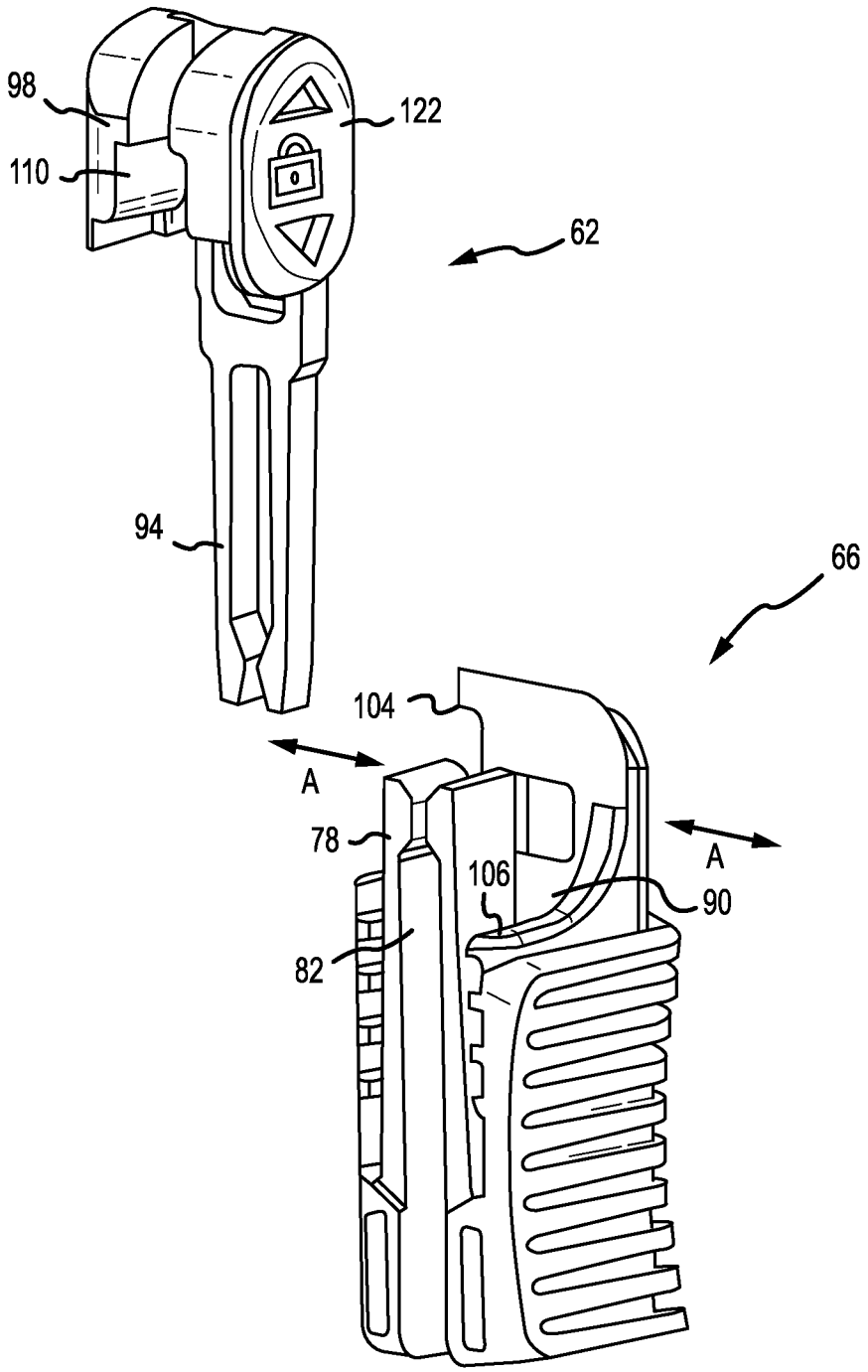

FIG. 8 is an exploded view of FIG. 7A.

Figure 9:
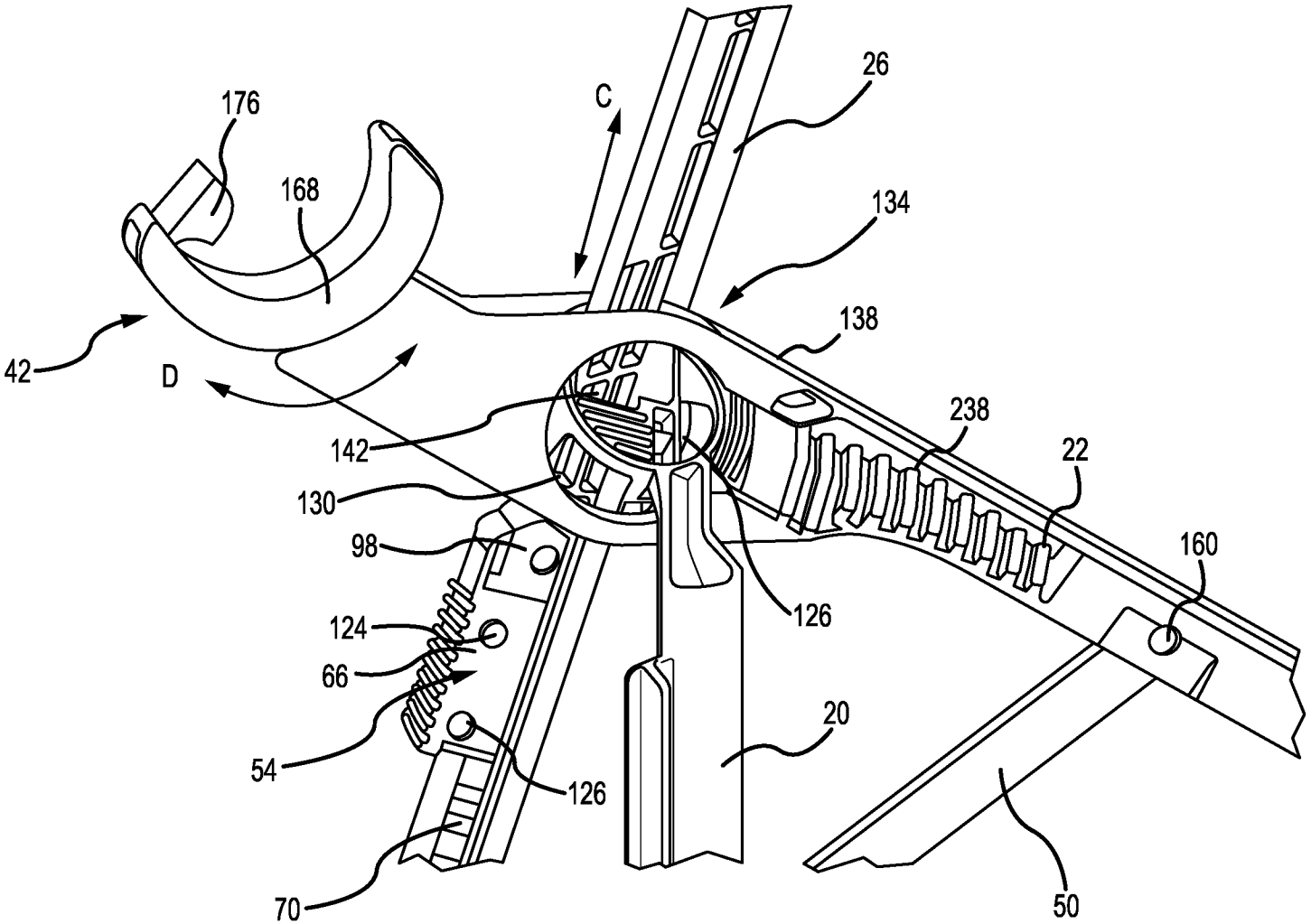

FIG. 9 is a detailed side perspective view illustrating the upper interconnection between an arm, a leg, cross frame member, and a cross link member of one embodiment of the present invention.

Figure 10:
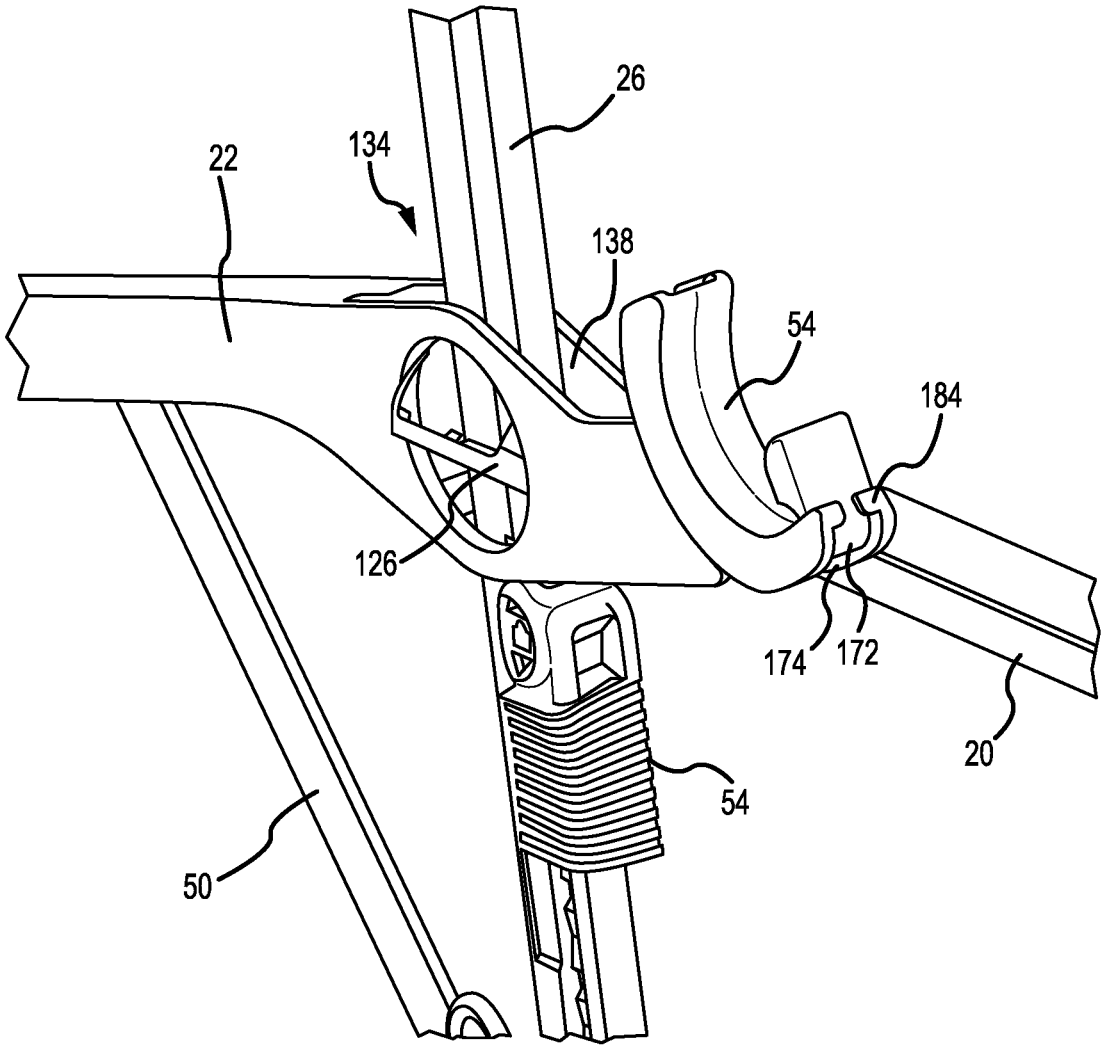

FIG. 10 is a detailed front perspective view showing the interconnected components shown in FIG. 9.

Figure 11:
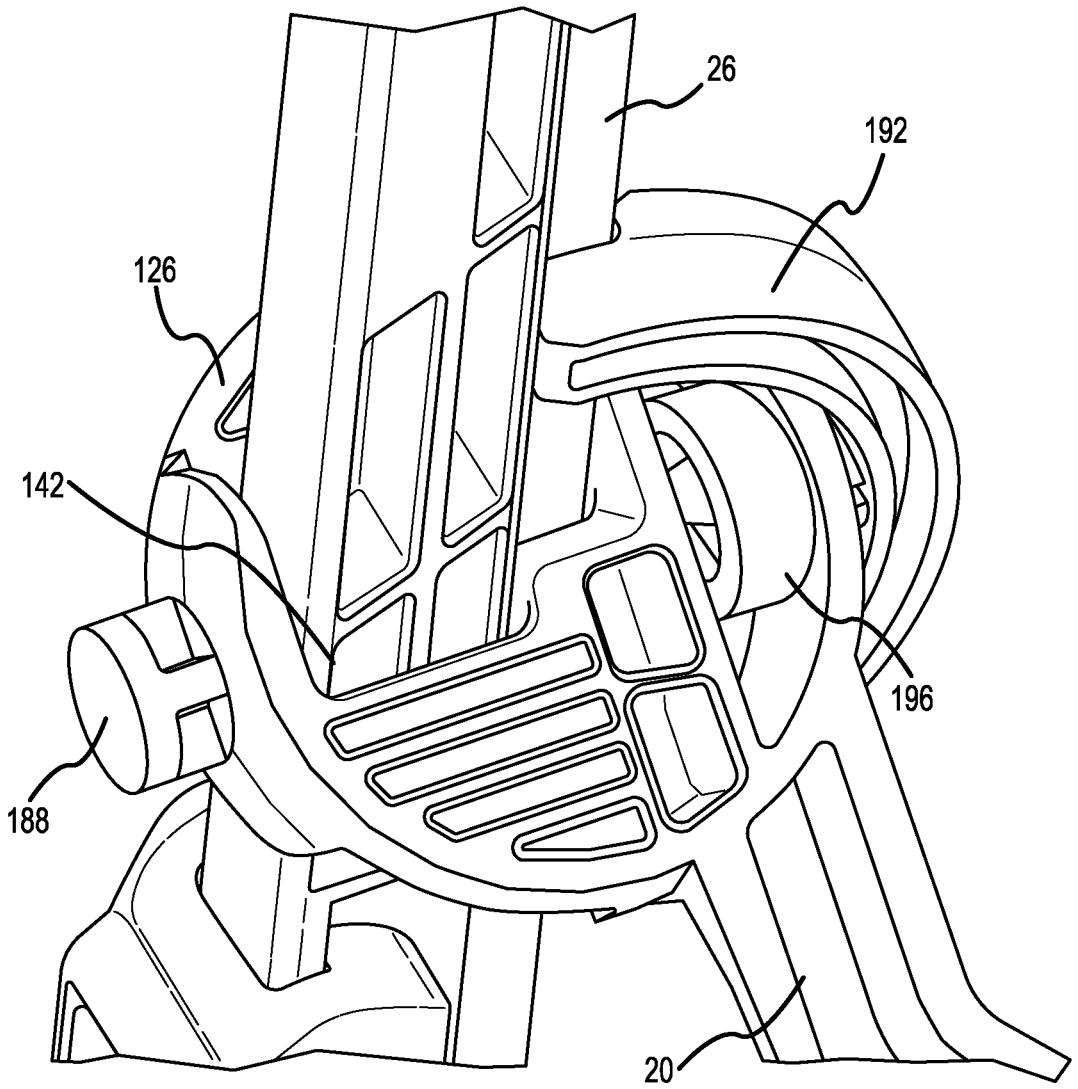

FIG. 11 is a detailed view illustrating the operative interconnection between the arm and a head of the cross member of one embodiment of the present invention.

Figure 12:
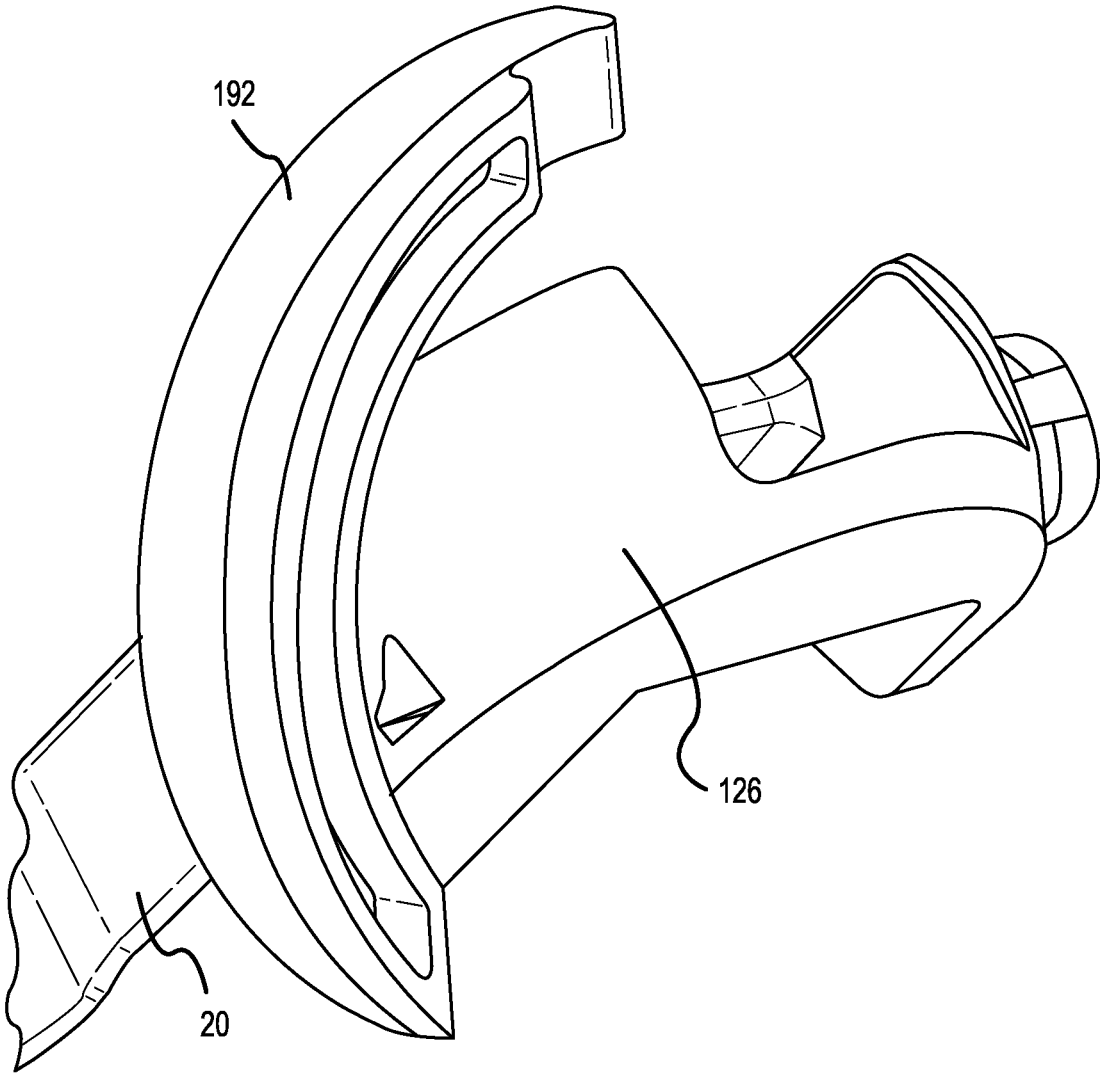

FIG. 12 is a detailed view focusing on the head of the cross frame member of one embodiment of the present invention.

Figure 13:
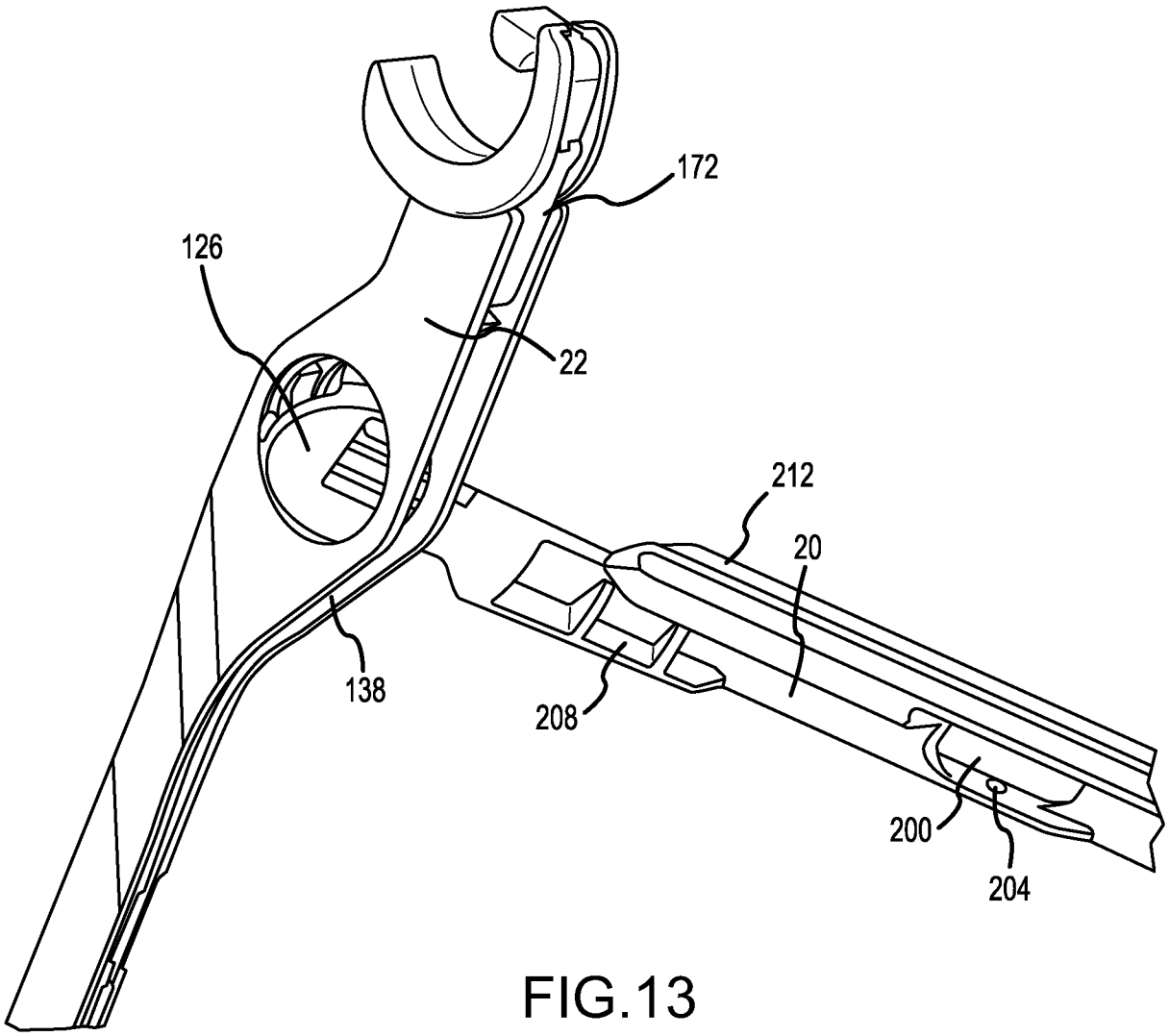

FIG. 13 is a perspective view showing features of the cross frame member of one embodiment of the present invention.

Figure 14:
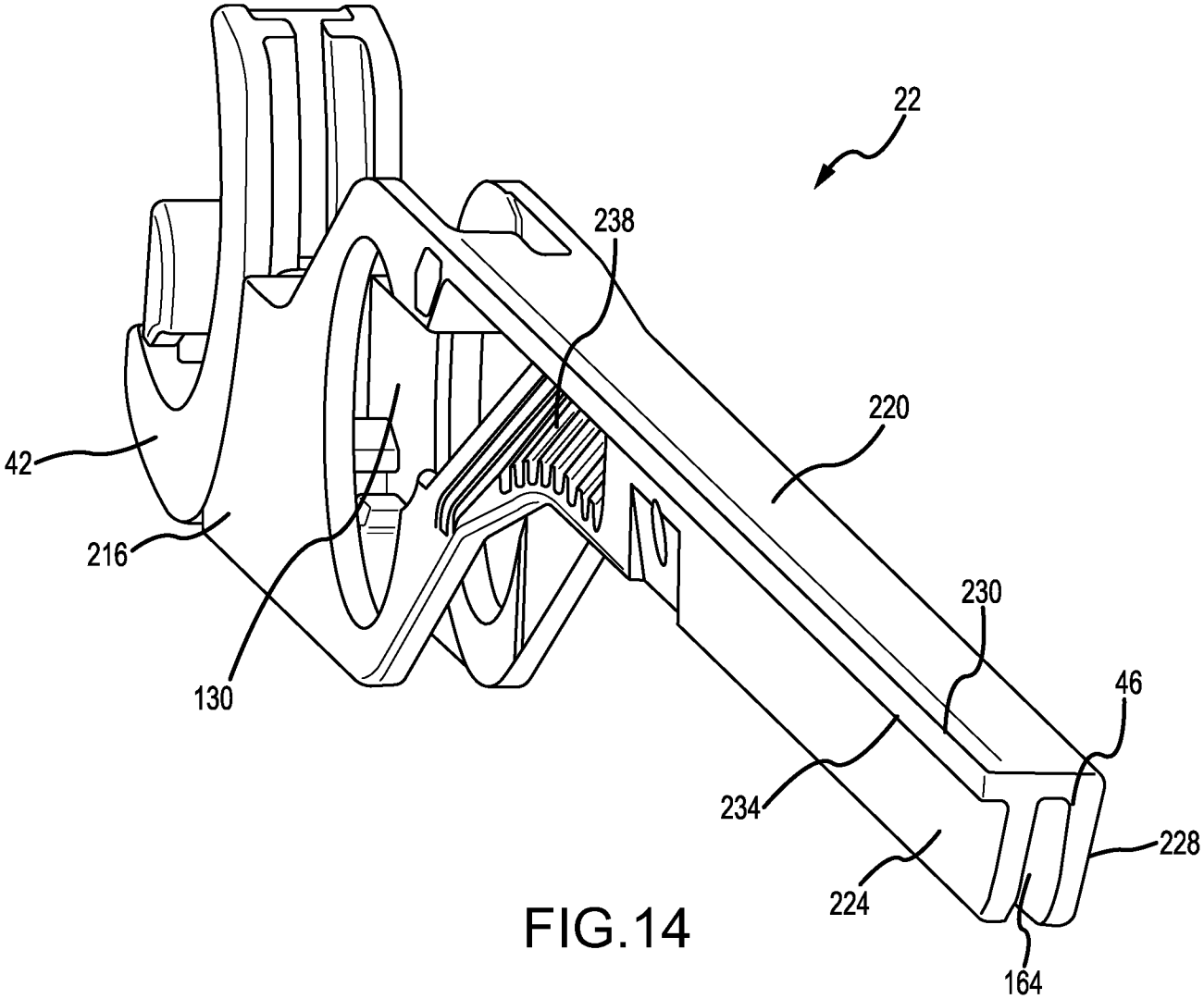

FIG. 14 is a perspective view of the leg employed by some embodiments of the present invention.

Figure 1:
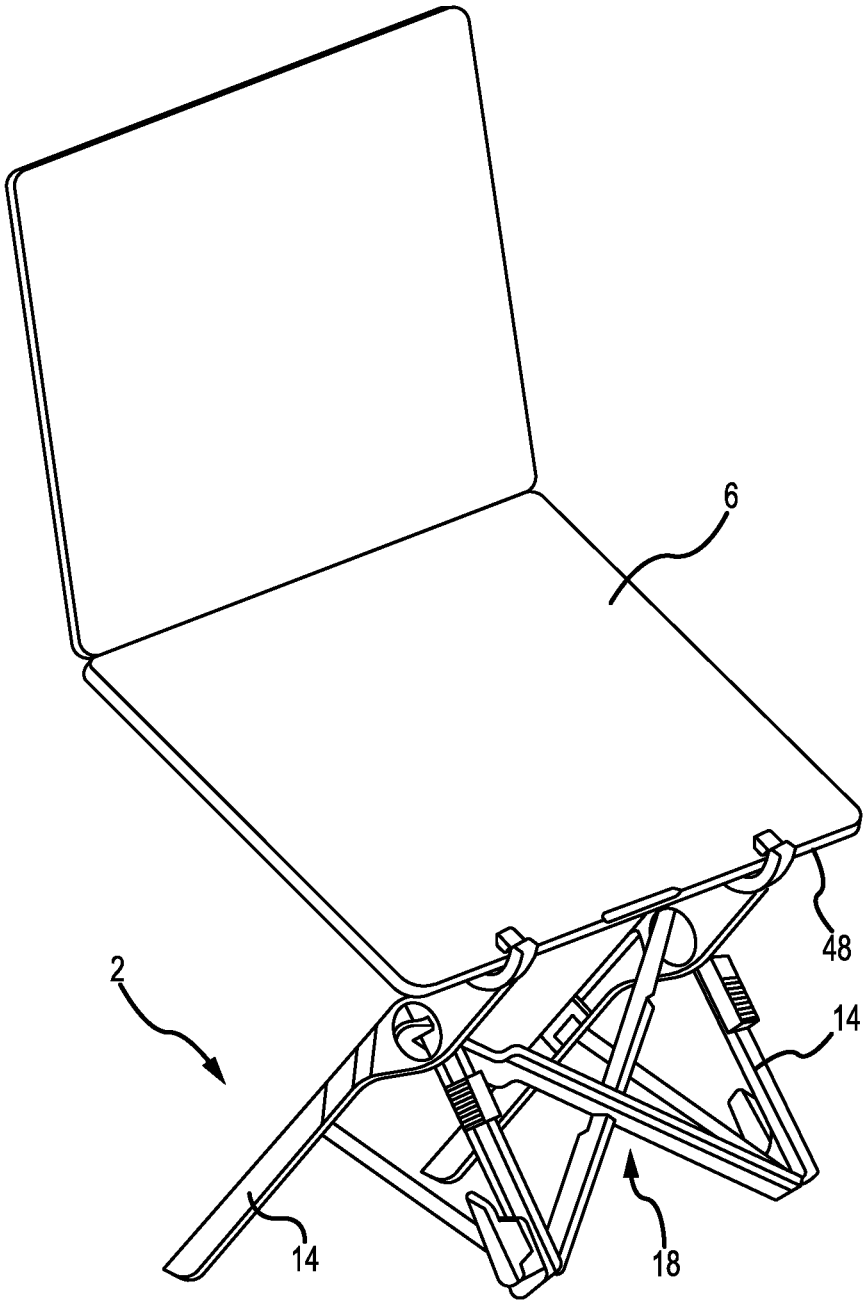
FIG. 1 is a perspective view showing a collapsible stand for supporting a laptop computer or similar device of one embodiment of the present invention.
Figure 2:
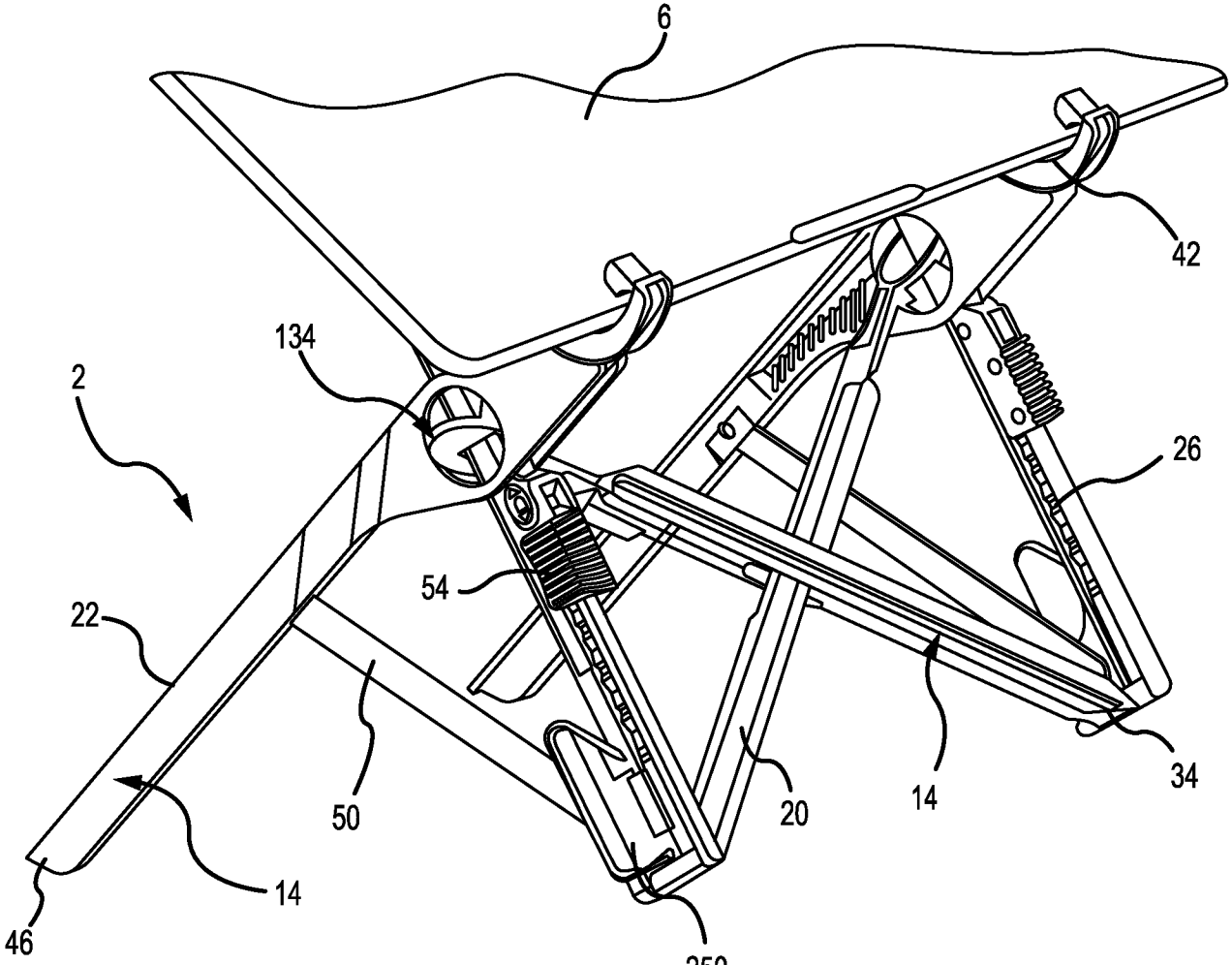
FIG. 2 is a detailed view of FIG. 1.
Figure 3:
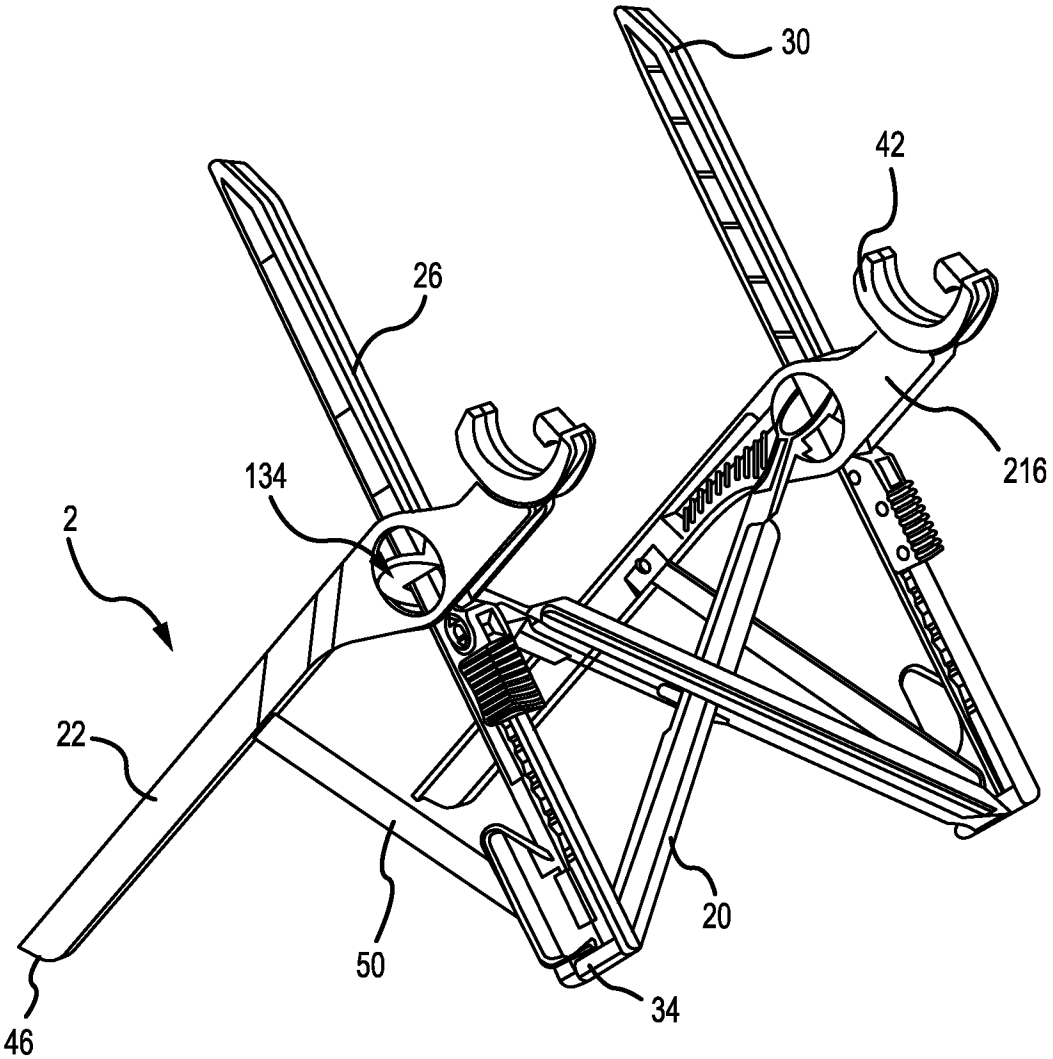
FIG. 3 is a perspective view of the stand of FIG. 1.
Figure 15:
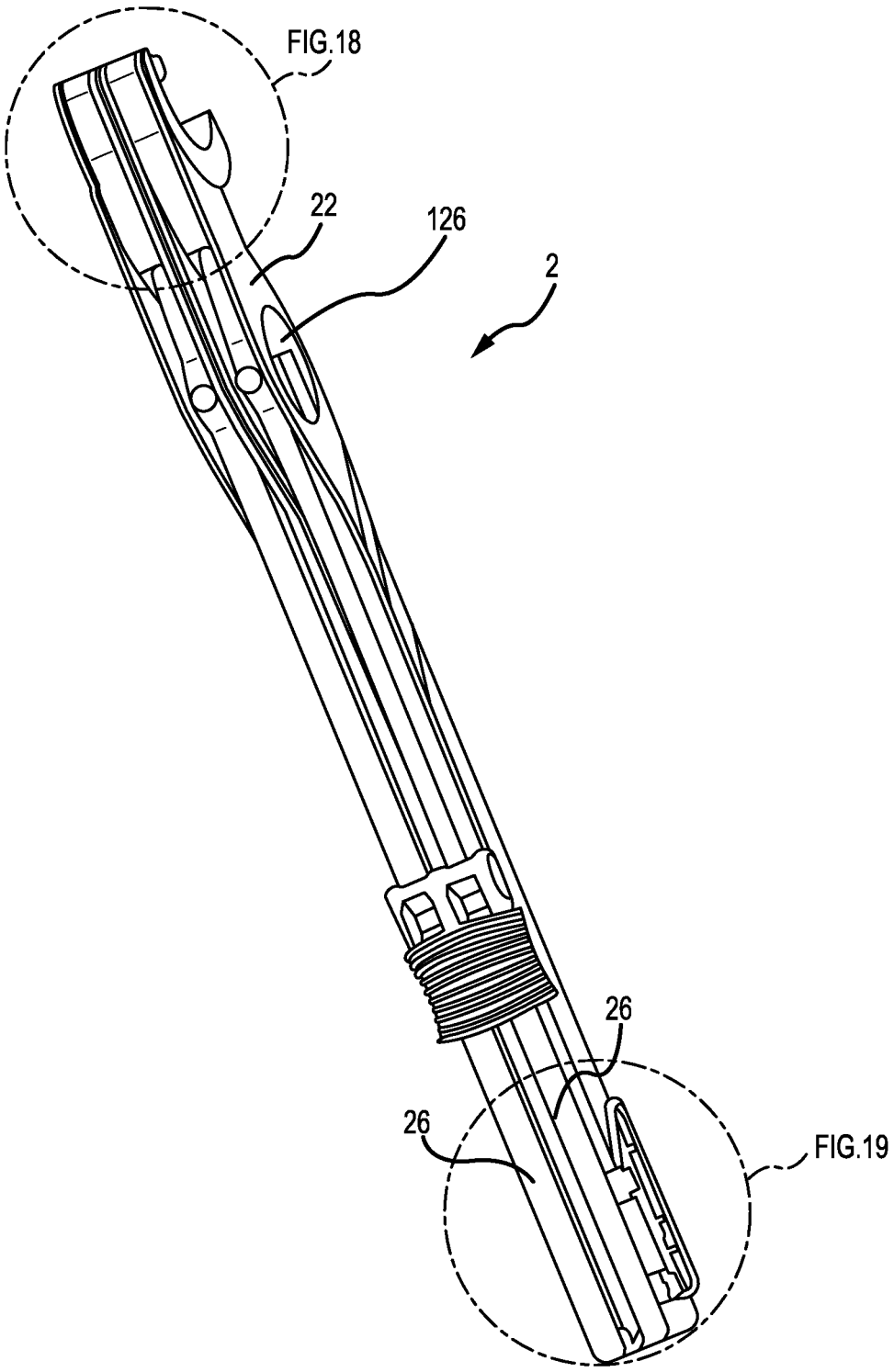

FIG. 15 is a front perspective view showing the stand of FIG. 3 in a collapsed position of use.

Figure 16:
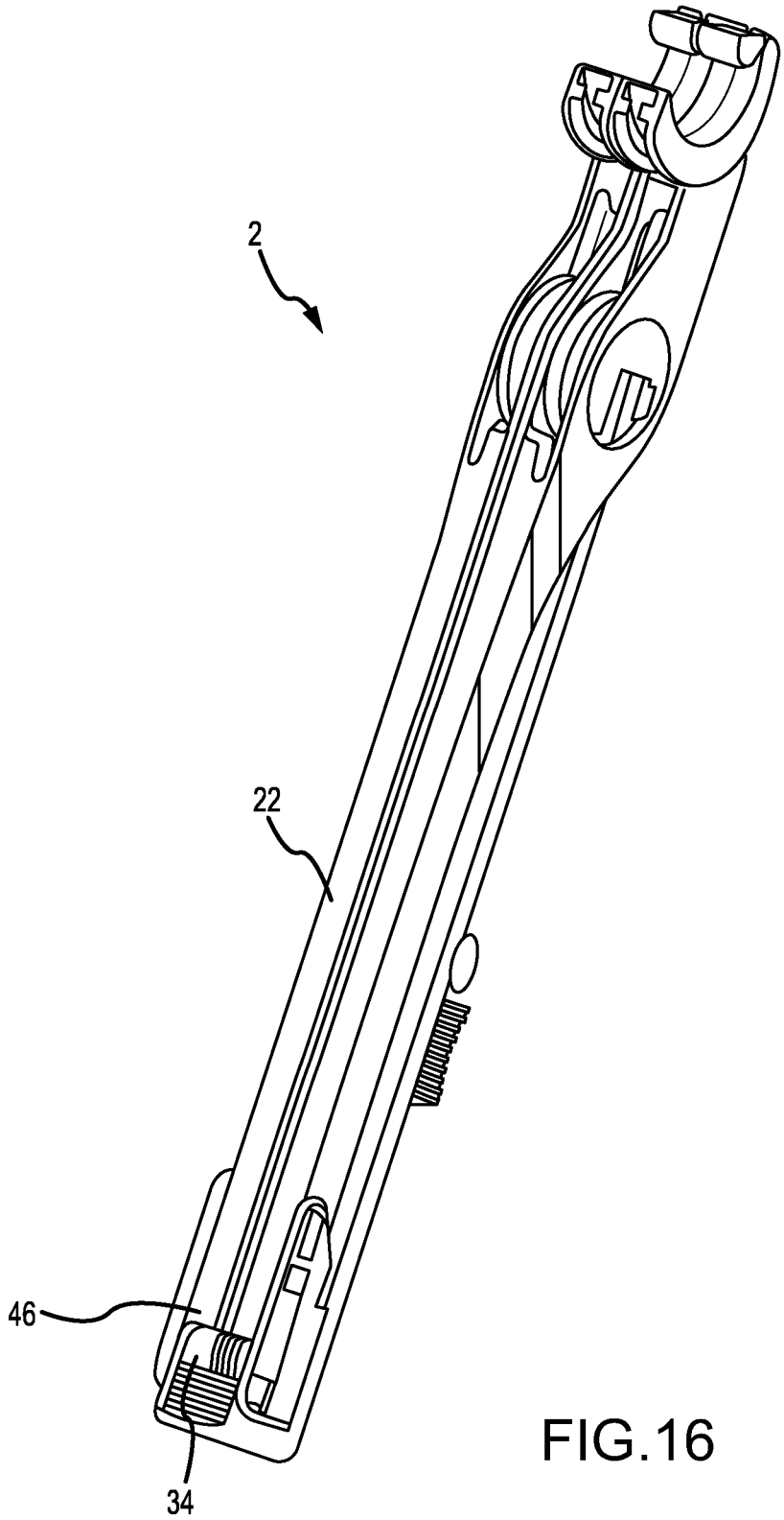

FIG. 16 is a rear perspective view showing the stand of FIG. 3 in the collapsed position of use.

Figure 17:
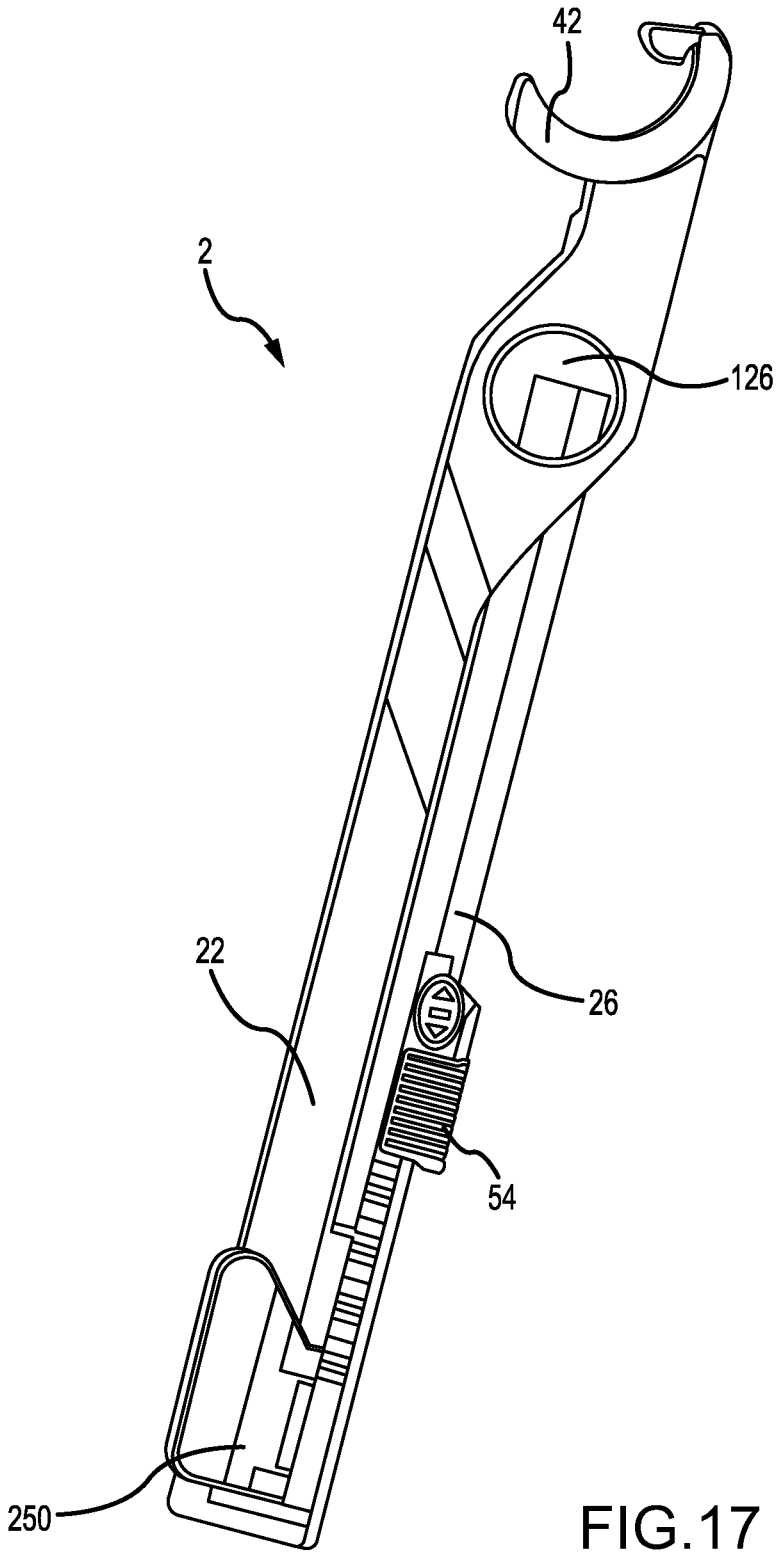

FIG. 17 is a side elevation view showing the stand of FIG. 3 in the collapsed position of use.

Figure 18:
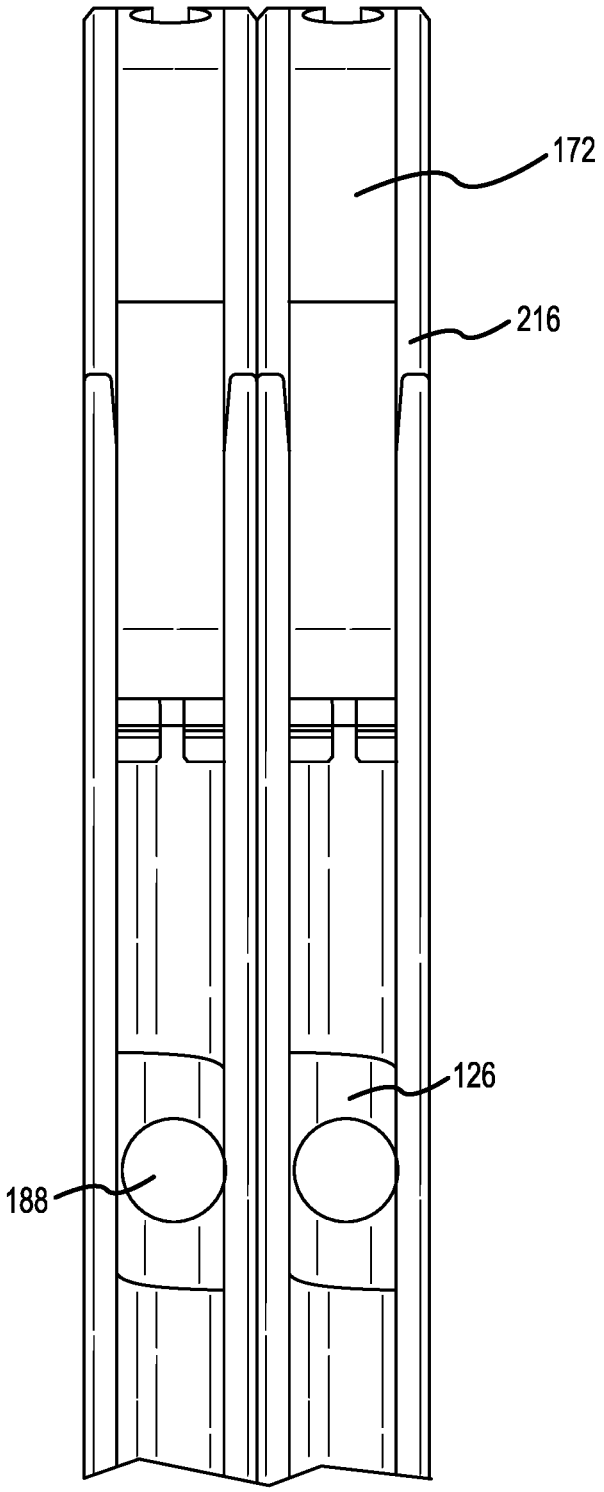

FIG. 18 is a detailed view of FIG. 15.

Figure 19:
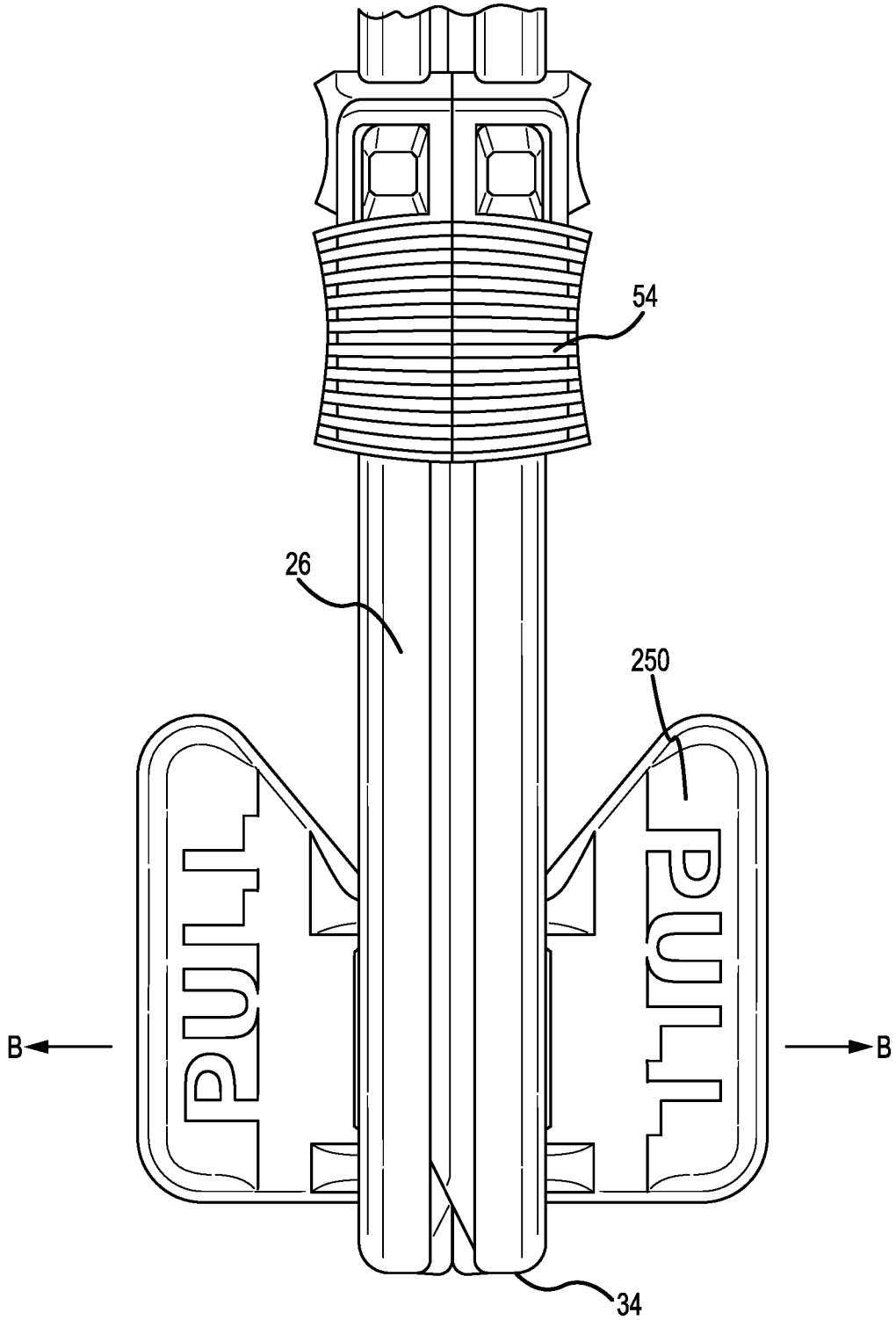

FIG. 19 is a detailed view of FIG. 15, wherein pull tabs are extended outwardly.

Figure 20:
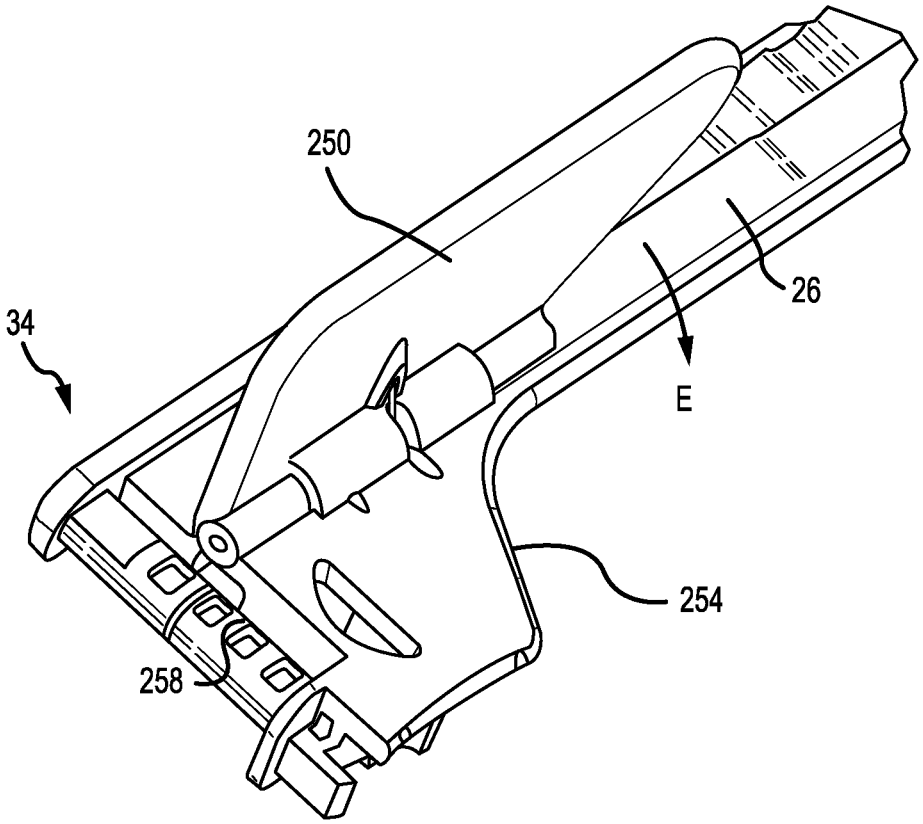

FIG. 20 is a detailed view of a base segment of the stand of one embodiment of the present invention showing a pull tab extended outwardly.

Figure 21:
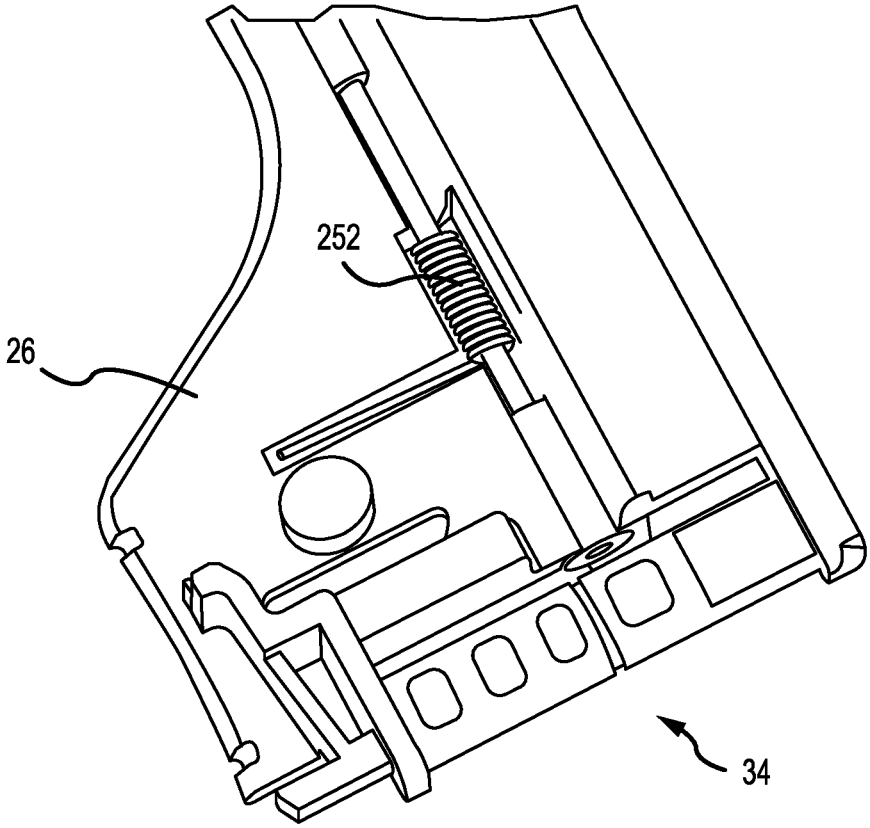

FIG. 21 is a detailed view oriented opposite that of FIG. 20, showing a biasing member that normally maintains the pull tab against the arm.

Figure 22:
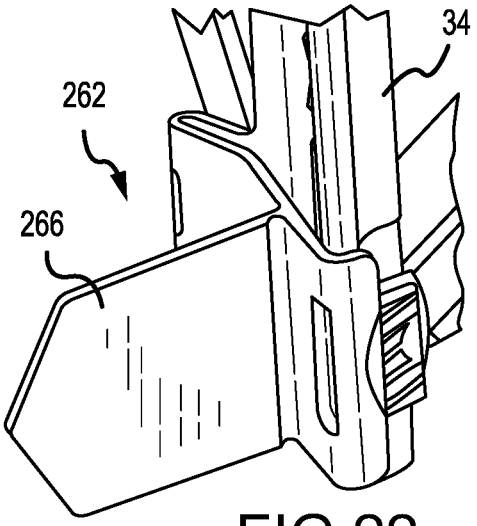

FIG. 22 is a perspective view showing a removable tab interconnected to a base segment of one embodiment of the present invention.

Figure 23:
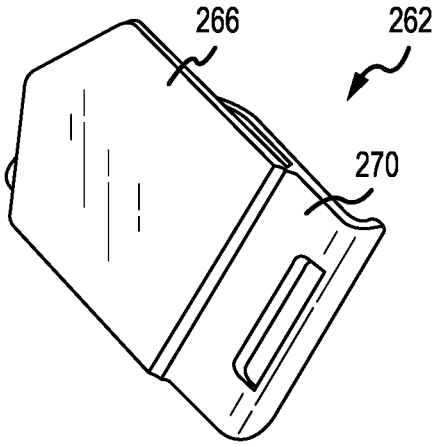

FIG. 23 is a front elevation view of the removable tab.

Figure 24:
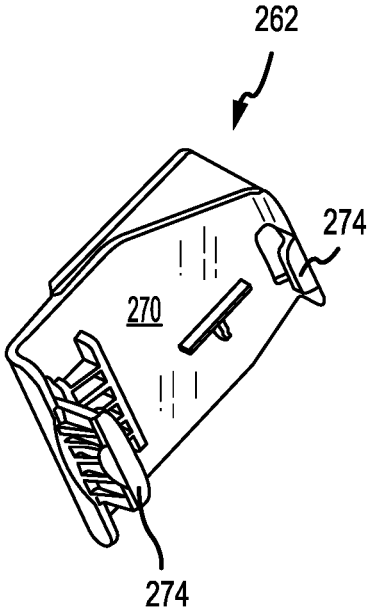

FIG. 24 is a rear elevation view of the removable tab.

Figure 25:
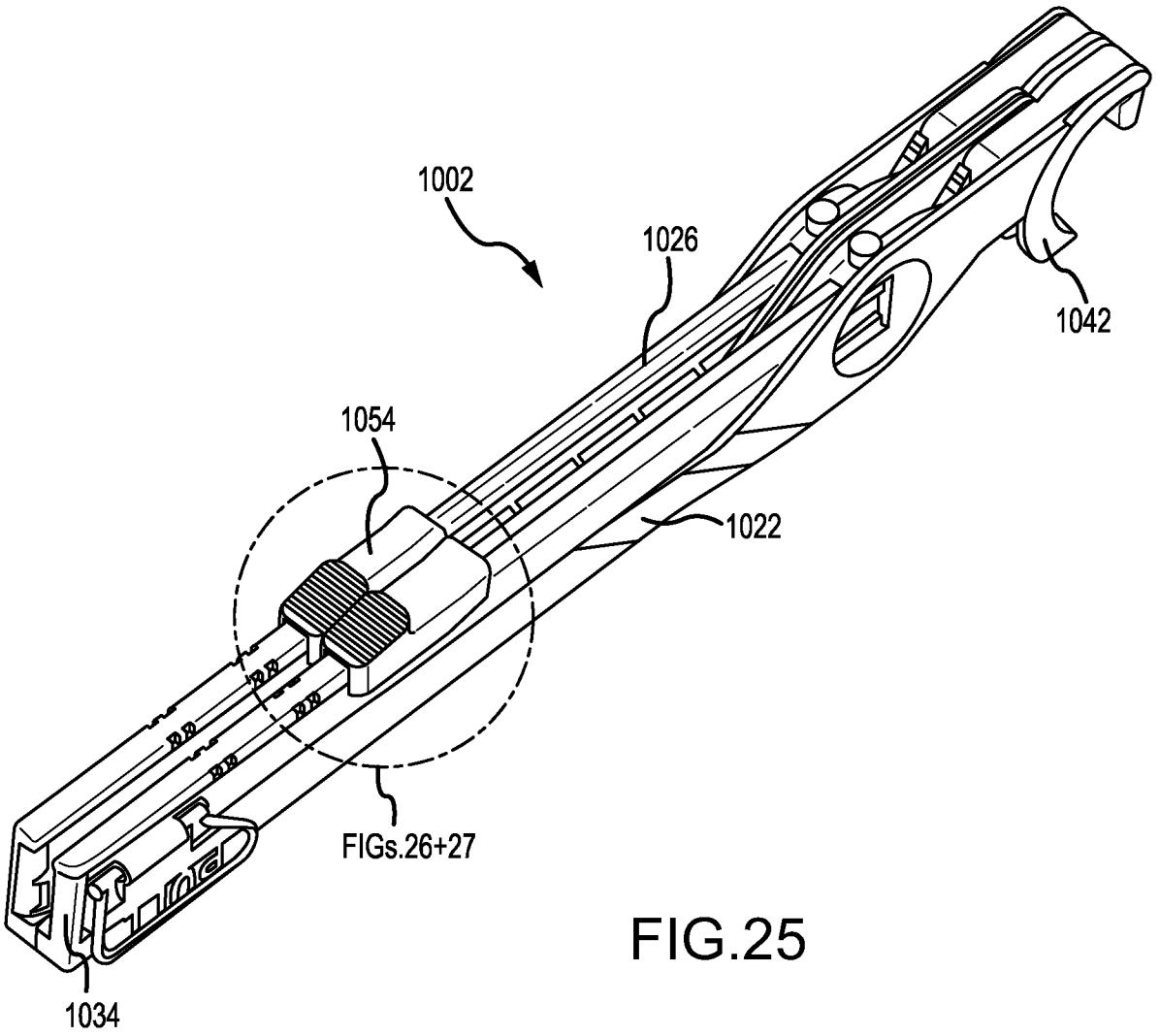

FIG. 25 is a perspective view of another embodiment of the present invention that employs an alternate height adjustment and maintaining mechanism.

Figure 26:
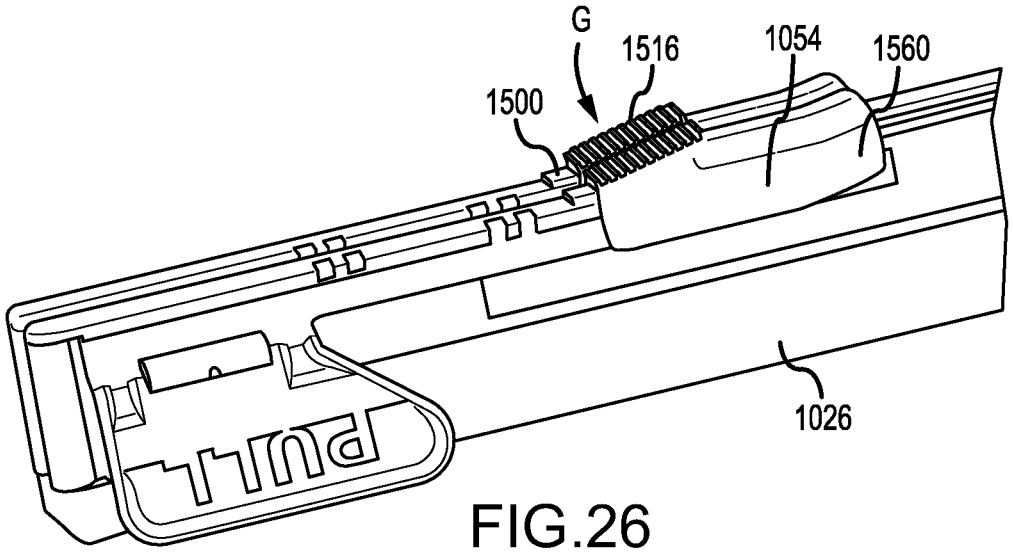

FIG. 26 is the height adjustment and maintaining mechanism of FIG. 25 in an open configuration.

Figure 27:
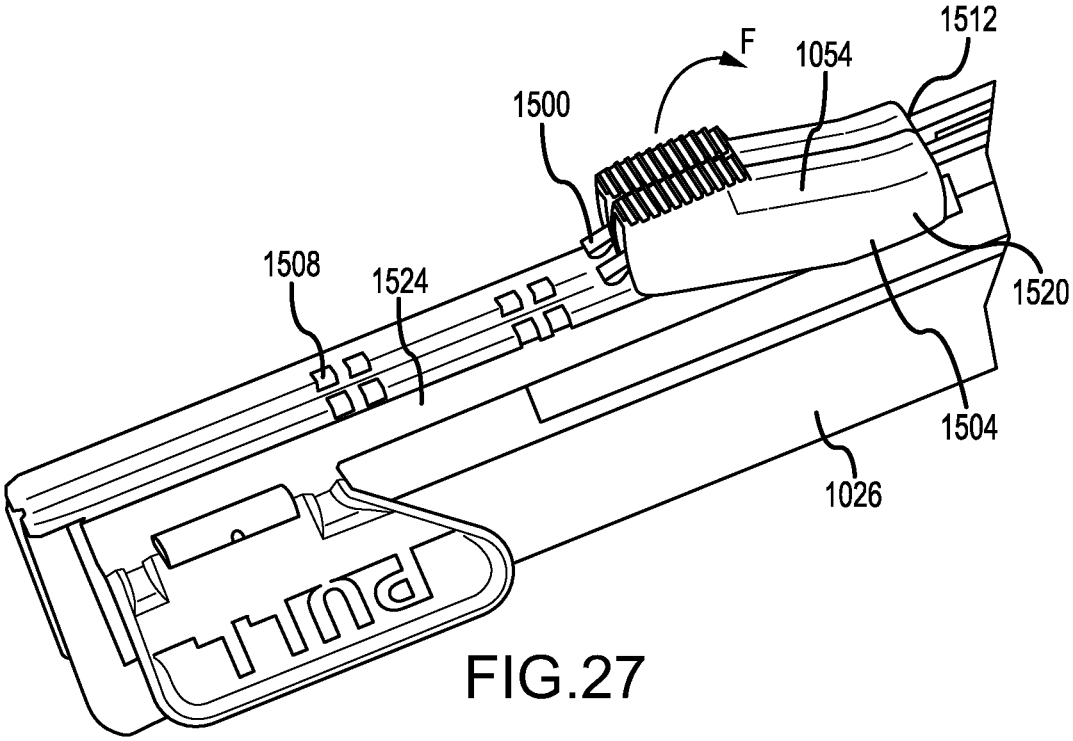

FIG. 27 is the height adjustment and maintaining mechanism of FIG. 25 in a closed configuration The following component list and associated numbering found in the drawings is provided to assist in the understanding of one embodiment of the present invention:

Component

2 Stand

6 Laptop computer

14 Side frame structure

18 Cross frame structure

20 Cross frame member
22 Leg
26 Arm
30 Engagement surface
34 Base segment
42 Gripping mechanism
46 Foot
48 Front edge
50 Cross link
54 Height adjustment mechanism
58 Flat surface
62 Lock
66 Carrier
70 Channel
74 Teeth
78 Locking protrusion
82 Lock arm
86 Lateral side surface
90 Longitudinal cavity
94 Finger
98 Body portion
102 Protrusion
104 Stop
106 Upper surface
110 Inwardly-facing surface
114 Outwardly-facing surface
118 Locking space
122 Thumb/finger pad
124 Detent
125 Cavity
126 Head
130 Socket
134 Slider mechanism
138 Longitudinal opening
142 Head opening
164 Longitudinal groove
168 Rotating member
172 Band
174 Channel
176 Nub
184 Finger
188 Pin
192 Retainer
196 Boss
200 Opening
204 Pin
208 Rib
212 Rib
216 Leg upper end
220 Outer surface
224 Inner sidewall
228 Outer sidewall
230 Ledge
234 Inner surface
238 Cavity
250 Pull tab
252 Spring
254 Outer surface
258 Hub
262 Removable pull tab
266 Tab portion
270 Gripping member
274 Finger
1002 Stand
1022 Leg
1026 Arm
1034 Base segment
1042 Gripping mechanism
1054 Height adjustment mechanism
1500 Spring
1504 Sidewall
1508 Cavity
1512 Upper Surface
1516 Finger groove
1520 Upper portion
1524 Channel It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 4:
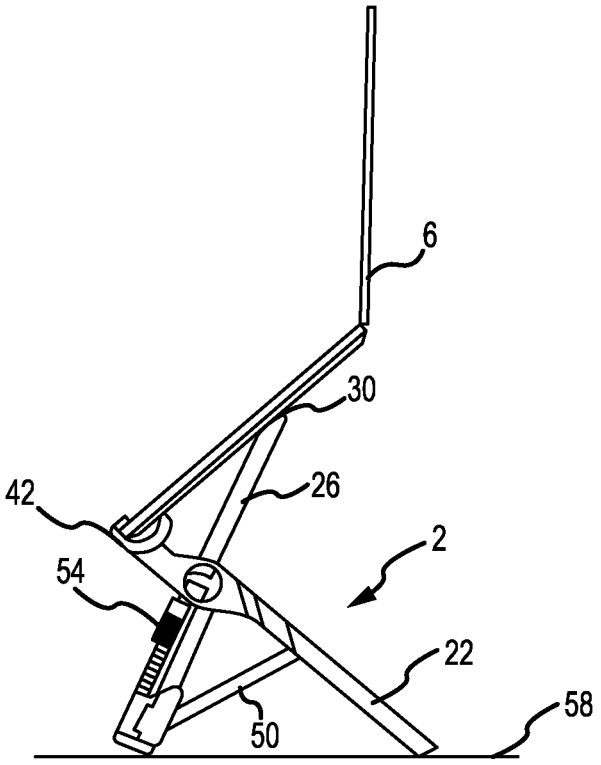
FIG. 4 is a right elevation view of the stand of FIG. 3 positioned at the first height.
Figure 5:
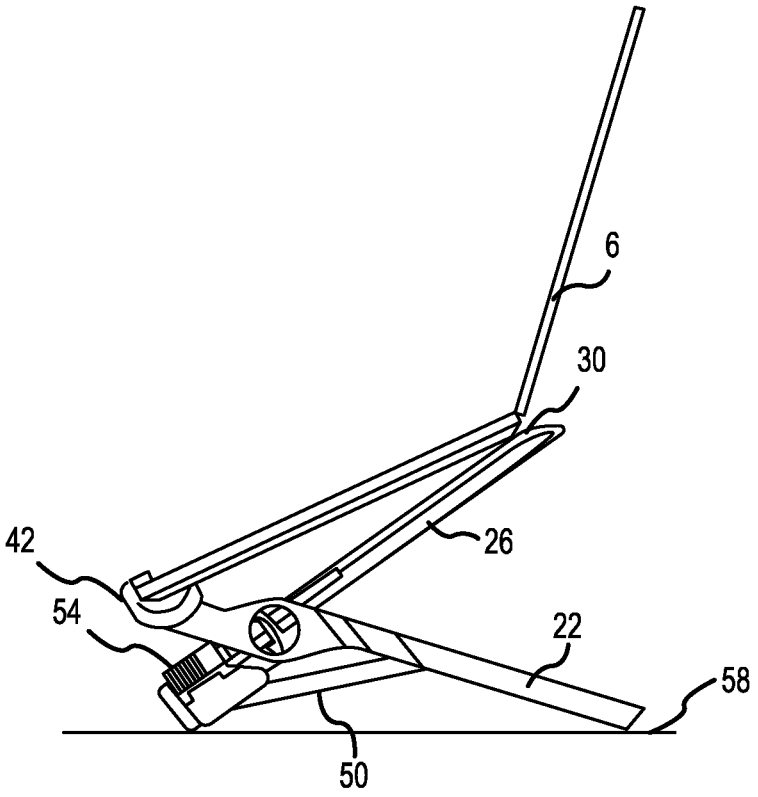
FIG. 5 is a right elevation view of the stand of FIG. 3 positioned at a second height.

FIGS. 1-5 show a stand 2 of one embodiment of the present invention configured to support a laptop computer 6. The stand 2 generally consists of opposing side frame structures 14 interconnected by a cross frame structure 18 consists of cross frame members 20. The side frame structures comprise a leg 22 and arm 26. The arm 26 includes a first end with an engagement surface 30 configured to receive the screen of the laptop computer 6 and a second end that forms at least a portion of a base segment 34 configured to rest on a flat surface. The leg 22, which is slidingly and rotatably associated with the arm 26, includes an upper end that accommodates a gripping mechanism 42 and a second end that acts as a foot configured to engage the flat surface. The gripping mechanism 42 is adapted to engage and secure a front edge 48 of the laptop computer 6. The leg 22 is further interconnected to the base segment 34 of the arm 26 by a cross link 50 to add stability to the expanded stand. In addition, some embodiments of the present invention are equipped with height adjusting functionality. Here, a height adjustment and maintaining mechanism 54 (hereinafter "height adjustment mechanism") is operatively interconnected to the arms 26, which will be described in further detail below. As shown in FIGS. 4 and 5, movement of the height adjustment mechanism 54 along the length of the arms 26 will alter the vertical distance between the gripping mechanism 42 and the flat surface 58 supporting the stand 2, thereby altering the height of the laptop computer.

FIGS. 6-8 show the height adjustment mechanism 54 of one embodiment of the present invention comprising a lock 62 operatively interconnected to a carrier 66. The height adjustment mechanism 54 is associated with at least one channel 70 integrated into the arms 26 of each side frame structure. The channel includes a plurality of teeth 74 that selectively interface with locking protrusions 78 provided on the carrier 66. The locking protrusions 78 are interconnected to the flexible lock arms 82 cantilevered to a base portion of the carrier 66. In operation, the lock arms 82 move outwardly and inwardly along Arrow A as the carrier 66 is moved along the arms 26 and the locking protrusions encounter lateral side surfaces 86 of the teeth. The lateral side surfaces 86 may be angled or arcuate to facilitate carrier movement. The carrier 66 also includes a longitudinal cavity 90 that receives fingers extending from a body portion 98 of the lock 62. The fingers 94 help guide the lock 62 into the carrier 66 and control the motion of the lock 62 relative to the carrier 66 as the lock is engaged and disengaged. As shown in FIG. 7C bodies 98 also include protrusions 102 that selectively engage stops 104 provided on an upper end of the carrier 66 to prevent extension of the lock beyond a predetermined distance.

In operation, when the lock 62 is disengaged from the carrier, i.e., when the body portion 98 is separated from the upper surface 106 of the carrier 66, the height adjustment mechanism 54 can slide along the arms 26. After a preferred laptop computer height is selected, the body portion 98 is brought into proximity with the upper surface 106 of the carrier 66 by using the thumb/finger pads 122, which engages an inward-facing surface 110 of the lock's body portion 98 onto an outwardly-facing surface 114 associated with the locking protrusions. When the height adjustment mechanism 54 is in the locked position as shown in FIG. 7, this engagement prevents the locking protrusions 78 from moving outwardly along Arrow A, which maintains the locking protrusions 78 within a locking space 18 located between adjacent teeth 74. Alternatively, the locking protrusions can be adapted to grip a leg Movement of the body portion from a locked to unlocked position along Arrow H may be facilitated by thumb/finger pads 122. The carriers 66 of corresponding arms may selectively interconnected to facilitate adjustment when the stand is in the collapsed configuration as shown in FIG. 19. For example, the carrier 66 and/or body portion 98 may include detents 124 that are selectively received in corresponding cavities 125 of adjacent height adjustment mechanism (see, FIGS. 8B and 9) to temporarily interconnect height adjustment mechanisms for coordinated movement. One of ordinary skill in the art will appreciate that other mechanisms may be used to selectively lock the height adjustment mechanisms relative to the arms, one of which is described herein.

FIGS. 9 and 10 illustrate how portions of the stand of one embodiment of the present invention are interconnected. Here, the cross frame member 20 includes a head 126 on its upper portion. The head 126 has a spherical outer profile that fits within a corresponding socket 130 integrated into each leg 22. Each leg 22 also defines a slider mechanism 134, which generally consists of a longitudinal opening 138 and a corresponding opening 142 in the head 126 that operatively receive the arm 26. In operation, when the base segments of the arms 26 are moved away from each other in the direction of Arrow B (see, FIG. 19), the slider mechanism 134 will urge the gripping mechanisms 42 away from each other. This motion will also move the slider mechanisms 134 downwardly along Arrow C towards the base segments. Eventually, a lower surface of the legs will abut the locks, thereby arresting the motion thereof and setting a laptop computer height. If a lock(s) is in the open position when the stand is expanded, the force exerted on upper portions of the body 98 by the lower surface of a leg will force the lock 62 into the carrier 66, thereby setting the location of the height adjustment mechanism 54 and preventing accidental movement of the leg lower than intended.

When the base segments are moved in the direction opposite to Arrow B, the side frame structures move closer to each other and the gripping mechanisms are rotated towards the engagement surfaces of the arms. The expanding/collapsing operation also causes the lower ends of the cross frame members to rotate about a pivot point associated with the base segment of the arms, which selectively changes the angle of the head relative to the outside surface of the leg. In one embodiment of the present invention, which will be described in further detail below, when fully collapsed, a portion of the head is substantially flush with the outer surface of the leg. Movement of the side frame structures will also cause the cross-link members 50 to rotate relative to a pivot point 160. A lower end of the cross link member 50 is also attached to a pivot point associated with the base segment, wherein movement of the side frame member to collapse the stand will conceal the cross link members 50 inside longitudinal grooves 164 provided in the legs 22 (see, FIG. 14).

The gripping mechanism 42 is very similar to that described in U.S. Pat. No. 9,894,988 mentioned above and includes a rotating member 168 that rides in an arcuate track (not shown). An elastic band 172 resides in a channel 174 and is operatively interconnected to the rotating member 168 that ends in a nub 176 that selectively engages the laptop's front edge. The rotating member 168 is, thus, configured to move along Arrow D to accommodate differing stand heights, computer sizes, etc. In one embodiment of the present invention, the band 172 is maintained within the channel 174 by at least one finger 184.

FIGS. 11 and 12 show the interaction between the arms 26 and the head 126, wherein the leg has been removed for clarity. The head of one embodiment has a spherical outer surface with a pin 188 extending therefrom configured to maintain the head's interconnection with the leg as it slides and rotates relative to the arm as the stand is expanded and collapsed. A retainer 192 is positioned opposite the pin 188 and is configured to interface with the inner surface of the socket to operatively secure the head 126. The retainer may include a boss 196 that receives a corresponding pin (not shown) inwardly extending from the retainer 192. The retainer 192 rotates within the socket when the stand is extended and collapsed, allowing the slider mechanism to move freely along the arm. The retainer also allows for the head to be interconnected to the socket during manufacturing. Alternatively, the retainer can be omitted, and the head may be snap-fit into the socket.

FIG. 13 highlights the cross frame member 20 of one embodiment of the present invention and its interactions with the leg operatively interconnected thereto. The cross frame member includes an opening 200 that receives the corresponding cross frame member, which is held in place by a pin 204 that interconnects the cross frame members that allows them to rotate relative to each other when the stand is collapsed and expanded. The cross frame members may also include stiffening ribs 208 that allows the cross frame member 20 to be made of thinner material if desired. Stiffening of the cross frame member is also achieved by perpendicularly disposed stiffening ribs 212 that substantially extend the entire length of the cross frame members. Because one cross frame member penetrates the other, the perpendicularly disposed stiffening rib 212 of one cross frame member will be located behind the perpendicularly disposed stiffening rib 212 of the other cross frame member. Accordingly, when collapsed, the rib 212 of the penetrating cross frame member will be nested behind the rib 212 of the forward-most cross frame member.

FIG. 14 shows a leg 22 of one embodiment of the present invention with an upper end 216 associated with the gripping mechanism 42 and a lower end associated with the foot 46. The leg 22 includes an outer surface 220 with sidewalls 224, 228 extending therefrom to define a longitudinal groove 164. The outer surface 220 may extend from the arm inner sidewall 224 to define a ledge 230. As will be appreciated upon review of FIG. 16, inner surfaces 234 of opposing legs 22 engage when the stand is in the collapsed position. The leg 22 may also include a cavity 238 configured to receive the rib 208 of the cross frame member 20 as the stand is transitioned into the collapsed position.

FIGS. 15-19 show the stand 2 and the collapsed configuration, wherein inner surfaces of the gripping mechanisms 42 are placed in close proximity. Also, as discussed above, portions of the legs contact to conceal the folded cross frame structure. Here, the feet of the side frame structures, which are located above the base segments 34, contact each other. The base segments may include a knurled surface to facilitate grasping by the user's thumbs and index fingers, which gives the user tactile confirmation of the correct grasping locations, which may prevent obstruction of the feet that would otherwise prevent outward motion of the base segments. Some embodiments of the present invention include pull tabs 250 attached to the base segments that may be biased against the outside surface of the arms, which will be described in further detail below. The pull tabs, which may be removable, facilitate expanding the stand and reduces the chances that the user will adversely affect the motion of the legs as they are deployed.

FIGS. 19 and 20 show the pull tabs 150 of one embodiment of the present invention operatively associated with the arms 26 of some embodiments of the present invention. The pull tabs 150 can employ a traditional hinge mechanism as shown or comprise a living hinge. The pull tabs 150 are biased with the spring 252, for example, in the direction of Arrow E, and lay flat against an outer surface 254 of the arm's base segments. In operation, the user counteracts the spring force by rotating the pull tabs 150 in the direction opposite Arrow E and pulls the base segments 34 away from each other in the direction of Arrow B. Once the stand is expanded, the user removes pressure from the pull tabs, which return to rest against the outer surface 254. This functionality virtually eliminates accidental user engagement with the feet, which allows for a smooth transition from the collapsed position to the expanded position. FIG. 19 also shows the height adjustment mechanisms 54 interconnected as a unit as mentioned above, which allows for the height of each side frame structure to be modified in the same fashion by moving both locks to the unlocked position. Finally, FIG. 20 shows a hub 58 that rotatably receives lower ends of the cross frame members.

One of ordinary skill in the art will appreciate that the pull tabs can be removable such that they are selectively interconnected to the end segments of each leg. More specifically, FIGS. 22-24 show a removable pull tab 262 comprising a tab portion 266 operatively interconnected to a gripping member 270. Here, a living hinge is provided that interconnects the tab portion 266 to the gripping member 270, but other mechanisms for rotatable interconnection are contemplated. In other embodiments, the orientation of the tab portion is fixed relative to the gripping member. In this embodiment, the gripping member 270 is interconnected to the base segment 34 by selectively to flexible fingers 274.

FIGS. 25-27 show a stand 1002 of another embodiment of the present invention that employs an alternate height adjustment mechanism 1054. FIG. 25 shows the stand 1002 and a collapsed configuration wherein corresponding height adjustment mechanism 1054 are engaged or selectively interconnected. The height adjustment mechanism 1054 of this embodiment is biased in the direction of Arrow F by a spring member 1500, for example. When positions in a closed position, as shown in FIG. 27, inwardly-extending detents (not shown) interconnected to an inner surface(s) of the height adjustment mechanism's 1054 sidewall 1504 are engaged within a locking cavity 1508 provided in the arms 1026. Once locked in place, an upper surface 1512 will arrest motion of the legs 1022 to as described above.

Unlocking the height adjustment mechanism 1054 is achieved by the application of pressure in the direction of Arrow G on to finger grooves 1516 provided on the height adjustment mechanisms 1054, which urges an upper portion 1520 of the height adjustment mechanism in the direction opposite to Arrow F. Once the locking detents are removed from the locking cavity 1508, the height adjustment mechanism 1054 is capable of movement along a channel 1524 provided in the outer surface of the leg 1026. One of ordinary skill in the art will appreciate that a corresponding channel may be provided in the inner surface of the leg and corresponding inwardly-disposed arcing cavities may be provided.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. A stand for supporting a computing device above a support surface, the stand comprising:

a first side frame structure including a first elongate frame member and a second elongate frame member, the second elongate frame member attached to the first elongate frame member such that the second elongate frame member is pivotable relative to the first elongate frame member and is slideable along a length of the first elongate frame member;

a second side frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member;

a first cross frame member having a first end operatively associated with the first elongate frame member and the second elongate frame member and a second end operatively interconnected of a base segment of the third elongate frame member;

the second cross frame member having a first end operatively associated with the third elongate frame member and the fourth elongate frame member and a second end operatively interconnected of a base segment of the first elongate frame member;

wherein the first cross frame member is operatively interconnected to the second cross frame member, wherein the first cross frame member and second cross frame member rotate relative to each other when the first side structure and second side structure are moved apart to configure the stand in an expanded position of use, and wherein the first cross frame member and second cross frame member rotate relative to each other when the first side structure and second side structure are moved together to configure the stand in a collapsed position of use;

a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the height adjustment and maintaining mechanism has an upper end having at least one inwardly-extending detent that is selectively biased towards the first frame member and received within a cavity provided in the first elongate member.

2. The stand of claim 1, wherein the height adjustment and maintaining mechanism slides along a channel provided in the first elongate frame member, wherein the cavity is defined as a space between a plurality of teeth provided in the channel, and wherein the at least one inwardly detent configured to engage a space provided between adjacent teeth when the at least one deflectable member is configured to move inwardly towards the first elongate frame member by a lock operatively interconnected to the carrier.

3. The stand of claim 1, wherein the height adjustment and maintaining mechanism is a first height adjustment and maintaining mechanism, and further comprising a second height adjustment and maintaining mechanism operatively interconnected to the third elongate frame member, the second height adjustment member configured to selectively slide along a portion of the third elongate frame member, the second height adjustment member configured to selectively engage and fixedly interconnect to a predetermined location on the third elongate frame member, and wherein the second height adjustment member has an upper surface configured to engage a portion of the fourth elongate member when the stand is positioned in the expanded position of use.

4. The stand of claim 1, wherein the second elongate member has a first opening that operatively receives the head of the first cross member and a second opening that the first elongate frame member passes through;

wherein the fourth elongate member has a third opening that operatively receives the head of the second cross member and a fourth opening that the third elongate frame member passes through;

wherein the head of the first cross member comprises a spherical outer profile that operatively interfaces with a corresponding profile provided in the first opening;

wherein the head of the second cross member comprises a spherical outer profile that operatively interfaces with a corresponding profile provided in the third opening;

wherein the head of the first cross member further comprises a fifth opening that the first elongate frame member passes through; and wherein the head of the second cross member further comprises a sixth opening that the first elongate frame member passes through.

5. The stand of claim 1, wherein the head of the first cross member further comprises a planar outer surface that is flush with an outer surface of the second elongate frame member when the stand is in the collapsed configuration of use, and wherein the head of the second cross member further comprises a planar outer surface that is flush with an outer surface of the fourth elongate frame member when the stand is in the collapsed configuration of use.

6. The stand of claim 1, wherein second and fourth elongate frame members include internal surfaces that contact each other when the stand is in the collapsed configuration of use to conceal the majority of rear surfaces of the first and second cross members.

7. The stand of claim 1, wherein:

the first side frame structure further includes a first cross link member pivotally attached at a first end to the first elongate frame member and at a second end to the second elongate frame member; and the second side frame structure further includes a second cross link member pivotally attached at a first end to the third elongate frame member and at a second end to the fourth elongate frame member.

8. The stand of claim 1, further including a first pull tab interconnected the base segment of the first elongate frame member, and a second pull tab interconnected the base segment of the third elongate frame member.

9. The stand of claim 8, wherein the first and second pull tabs are biased against corresponding outer surfaces of first and second elongate frame members.

10. The stand of claim 1, wherein the second elongate member and the fourth elongate member each include a gripping mechanism adapted to selectively engage a portion of the computing device, the gripping mechanisms including members configured to move in an arcuate path relative to the second elongate member and the fourth elongate member.

11. The stand of claim 10, wherein the gripping mechanisms further include elastic members attached to the member and respective second or fourth elongate frame members, the elastic members located in channels integrated into the members and held in place by at least one inwardly-extending finger.

12. A stand for supporting a computing device above a support surface, the stand comprising:

a first side frame structure including a first elongate frame member and a second elongate frame member, the second elongate frame member attached to the first elongate frame member such that the second elongate frame member is pivotable relative to the first elongate frame member and is movable along a length of the first elongate frame member;

a second side frame structure including a third elongate frame member and a fourth elongate frame member, the fourth elongate frame member attached to the third elongate frame member such that the fourth elongate frame member is pivotable relative to the third elongate frame member and is movable along a length of the third elongate frame member;

operatively interconnected cross frame members interconnecting the first side frame structure to the second side frame structure, wherein the cross frame members rotate relative to each other when the first side frame structure and second side frame structure are moved apart to configure the stand in an expanded position of use and moved together to configure the stand in a collapsed position of use;

a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the expanded position of use; and wherein the height adjustment and maintaining mechanism slides along a channel provided in the first elongate frame member that includes a plurality of teeth, and wherein the height adjustment and maintaining mechanism is comprised of a carrier with at least one deflectable member ending in a protrusion configured to engage a space provided between adjacent teeth.

13. The stand of claim 12, further including a first pull tab interconnected the base segment of the first elongate frame member, and a second pull tab interconnected the base segment of the third elongate frame member.

14. The stand of claim 12, wherein the second elongate member and the fourth elongate member each include a gripping mechanism adapted to selectively engage a portion of the computing device, the gripping mechanisms including members configured to move in an arcuate path relative to the second elongate member and the fourth elongate member.

15. A stand for supporting a computing device above a support surface, the stand comprising:

a first side-frame structure including a first elongate frame member and a second elongate frame member, the second elongate frame member attached to the first elongate frame member such that the second elongate frame member is pivotable relative to the first elongate frame member and is slideable along a length of the first elongate frame member, the second elongate frame member including an upper end portion that extends beyond the first elongate frame member, the upper end portion of the second elongate frame member and an upper end portion of the first elongate frame member are each configured to engage the computing device when the stand is in a fully-extended position;

a second side-frame structure including a third elongate frame member and a fourth elongate frame member, the fourth elongate frame member attached to the third elongate frame member such that the fourth elongate frame member is pivotable relative to the third elongate frame member and is slideable along a length of the third elongate frame member, the fourth elongate frame member including an upper end portion that extends beyond the third elongate frame member, the upper end portion of the fourth elongate frame member and an upper end portion of the third elongate frame member are each configured to engage the computing device when the stand is in the fully-extended position;

a cross-frame structure positioned between the first and second side-frame structures, the cross-frame structure attached to the first and second side-frame structures such that the first and second side-frame structures are oriented substantially parallel to one another during collapse of the stand from the fully-extended position to a fully-collapsed position, wherein each of the first, second, third, and fourth elongate frame members is oriented at an oblique angle relative to the support surface when the stand is in the fully-extended position;

the improvement comprising:

a height adjustment and maintaining mechanism operatively interconnected to the first elongate frame member, the height adjustment member configured to selectively slide along a portion of the first elongate frame member, the height adjustment member configured to selectively engage and fixedly interconnect to a predetermined location on the first elongate frame member, and wherein the height adjustment and maintaining mechanism has an upper surface configured to engage a portion of the second elongate member when the stand is positioned in the fully-extended position, and wherein the height adjustment and maintaining mechanism slides along a channel provided in the first elongate frame member that includes a plurality of teeth, and wherein the height adjustment and maintaining mechanism is comprised of a carrier with at least one deflectable member ending in a protrusion configured to engage a space provided between adjacent teeth.

16. The stand of claim 15, further including a first pull tab interconnected a base segment of the first elongate frame member, and a second pull tab interconnected the base segment of a third elongate frame member.

17. The stand of claim 15, wherein the second elongate member and the fourth elongate member each include a gripping mechanism adapted to selectively engage a portion of the computing device, the gripping mechanisms including members configured to move in an arcuate path relative to the second elongate member and the fourth elongate member.

* * * * *